US006580333B2

(12) United States Patent
Hasegawa

(10) Patent No.: US 6,580,333 B2
(45) Date of Patent: Jun. 17, 2003

(54) NONRECIPROCAL CIRCUIT DEVICE FOR A COMMUNICATION APPARATUS WITH MATCHING CAPACITORS HAVING SPECIFIC SELF-RESONANCE

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/805,387

(22) Filed: Mar. 13, 2001

(65) Prior Publication Data

US 2002/0021181 A1 Feb. 21, 2002

(30) Foreign Application Priority Data

Mar. 13, 2000 (JP) ..... 2000-068189
May 25, 2000 (JP) ..... 2000-155380

(51) Int. Cl.[7] ..... H01P 1/383; H01P 1/36
(52) U.S. Cl. ..... 333/1.1; 333/24.2
(58) Field of Search ..... 333/1.1, 24.2

(56) References Cited

U.S. PATENT DOCUMENTS 4,236,125 A * 11/1980 Bernard et al. ..... 333/1.1
5,023,578 A * 6/1991 Kaneko et al. ..... 333/185
5,495,210 A * 2/1996 Forterre et al. ..... 333/1.1
6,147,576 A * 11/2000 Arevalo ..... 333/176

FOREIGN PATENT DOCUMENTS

EP 0903802 3/1999 ..... H01P/1/387
JP 1093308 4/1998 ..... H01P/1/383

* cited by examiner

*Primary Examiner*—Justin P. Bettendorf
(74) *Attorney, Agent, or Firm*—Keating & Bennett, LLP

(57) ABSTRACT

A compact nonreciprocal circuit device in which a large amount of attenuation can be obtained at a predetermined frequency band without increasing cost. In this nonreciprocal circuit device, three central conductors are arranged in such a manner that the conductors mutually intersect on a ferrite member to which a DC magnetic field is applied. A matching capacitor connected to the port of a first central conductor is designed to have a low self-resonance frequency so as to be equal to or lower than four times the central frequency of a pass band. With this arrangement, since the matching capacitor acts as a trap filter, major spurious components such as the second harmonic and third harmonics can be efficiently attenuated without increasing the number of components to be used.

11 Claims, 15 Drawing Sheets

FIG. 6A
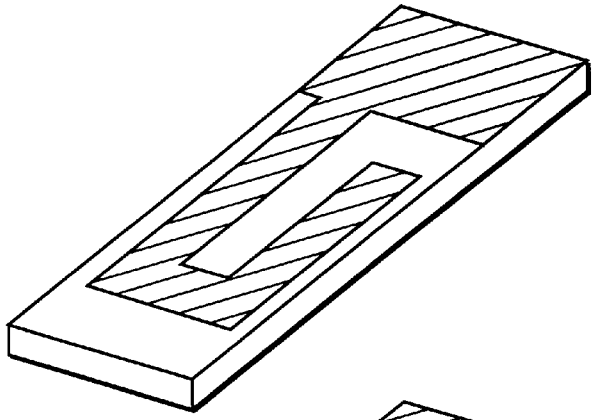
FIG. 6B
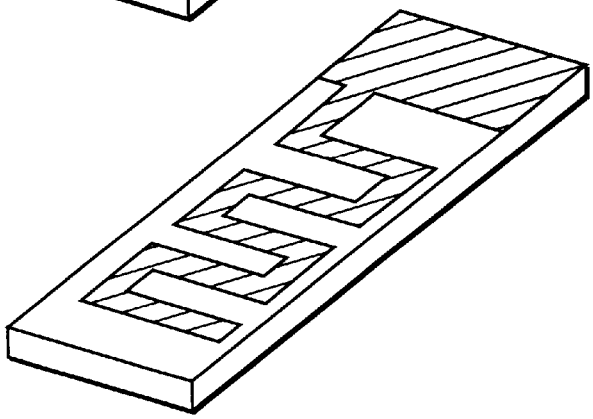
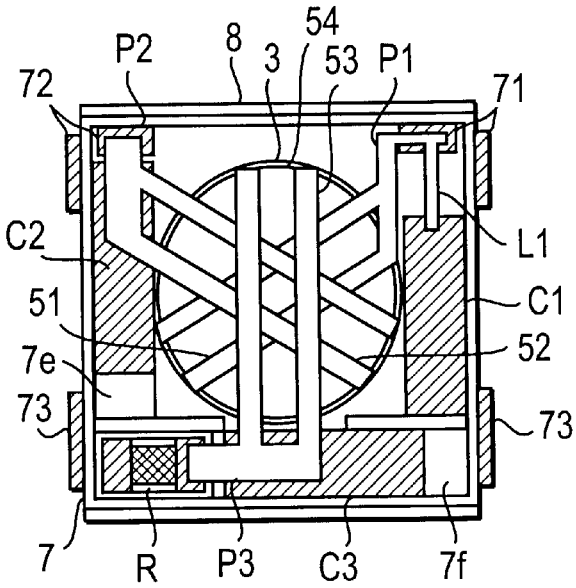
FIG. 7A
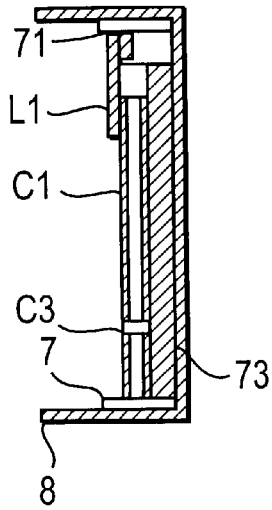
FIG. 7B

NONRECIPROCAL CIRCUIT DEVICE FOR A COMMUNICATION APPARATUS WITH MATCHING CAPACITORS HAVING SPECIFIC SELF-RESONANCE

BACKGROUND OF THE INVENTION

1. Field of the Invention

The present invention relates to a nonreciprocal circuit device such as an isolator or a circulator used in a high frequency band, for example, in a microwave band. In addition, the invention relates to a communication apparatus incorporating the nonreciprocal circuit device.

2. Description of the Related Art

In conventional nonreciprocal circuit devices such as lumped-constant isolators and circulators, attenuation in a signal-propagating direction is extremely small, whereas attenuation in the opposite direction is extremely great. Thus, the conventional nonreciprocal circuit devices having such characteristics are widely used in communication apparatuses to allow oscillators and amplifiers to act in a stable manner while maintaining their functions.

FIG. 19 shows an exploded perspective view of a conventional isolator, and each of FIGS. 20A and 20B shows the inner structure of the isolator. FIG. 21 shows an equivalent circuit diagram of the isolator.

As shown in FIG. 19 and FIGS. 20A and 20B, in the lumped-constant isolator, a magnetic assembly 5 composed of a ferrite member 54 and central conductors 51, 52, and 53, a permanent magnet 3, and a resin frame 7 are arranged in a magnetic closed circuit composed of an upper yoke 2 and a lower yoke 8. In the resin frame 7, port P1 of the central conductor 51 is connected to an input/output terminal 71 and a matching capacitor C1. Port P2 of the central conductor 52 is connected to an input/output terminal 72 and a matching capacitor C2. Port P3 of the central conductor 53 is connected to a matching capacitor C3 and a termination resistor R. One end of each of the capacitors C1, C2, and C3 and one end of the termination resistor R are connected to grounds 73.

In the equivalent circuit shown in FIG. 21, the ferrite member has a disk-like shape and a DC magnetic field is indicated by the symbol H. The central conductors 51, 52, and 53 are shown as equivalent inductors L. In such a circuit structure, forward-direction characteristics are equivalent to the characteristics of a band pass filter. In frequency bands distant from the pass band, even in the forward direction, signals are slightly attenuated.

In general, in a conventional communication apparatus, an amplifier used in a circuit of the apparatus usually causes some distortions. This is a factor producing spurious components such as the second and third harmonics of a fundamental frequency, by which unnecessary radiation is generated. Since such unnecessary radiation emitted from the communication apparatus causes the malfunction of a power amplifier and a problem of interference, standards and specifications are determined in advance to suppress the unnecessary radiation below a certain level. In order to prevent the unnecessary radiation, it is effective to use an amplifier having good linearity. However, since such an amplifier costs much, for example, a filter is usually used to attenuate unnecessary frequency components. Still, such a filter is expensive and the size of the apparatus increases. In addition, there is a loss generated by the filter.

Thus, it is considered that spurious components can be suppressed by using the characteristics of a band pass filter included in an isolator or a circulator. However, it is impossible to obtain sufficient attenuation characteristics in unnecessary frequency bands by using the conventional nonreciprocal circuit device having a basic structure shown in each of FIGS. 19 to 21.

In order to solve the above problems to obtain a large amount of attenuation in spurious frequency bands such as the second and third harmonics of a fundamental frequency, there is disclosed a nonreciprocal circuit device in Japanese Unexamined Patent Application Publication No. 10-93308. Each of FIG. 22, FIGS. 23A and 23B, and FIG. 24 shows an isolator as an example of the nonreciprocal circuit device. FIG. 22 shows an exploded perspective view of the isolator. Each of FIGS. 23A and 23B shows the inner structure of the isolator. FIG. 24 shows an equivalent circuit diagram of the isolator.

Unlike the isolator shown in each of FIGS. 19 to 21, this isolator includes an inductor Lf for a band pass filter. The inductor Lf is connected between port P1 of a central conductor 51, a matching capacitor C1, and an input/output terminal 71. As the inductor Lf, a solenoid coil is used, which is adaptable to miniaturization of the circuit structure. An isolator applied in the 1 GHz band uses a coil having an inductance of approximately 24 nH. More specifically, the used coil is formed by making nine turns of a copper wire having a width $\phi$ of 0.1 mm with an outside diameter $\phi$ of 0.8 mm.

A capacitor Cf is connected in series to the input/output terminal 71 of the isolator having the above structure. With this arrangement, as seen in the equivalent circuit diagram shown in FIG. 24, the capacitor Cf and the inductor Lf form a band pass filter. As a result, the signal components of frequencies distant from the pass band can be attenuated.

FIG. 25 shows a graph illustrating frequency characteristics of the isolator (a first conventional example) shown in FIGS. 19 to 21 and the isolator (a second conventional example) shown in FIGS. 22 to 24. This graph shows the frequency characteristics of the isolators applied in the 1-GHz band. When a comparison is made between the first conventional isolator and the second conventional isolator, it is found that attenuation of the second harmonic (2 GHz) is increased from 20.2 dB to 33.3 dB, and attenuation of the third harmonic (3 GHz) is increased from 28.2 dB to 46.4 dB.

Thus, when the solenoid coil is arranged in the nonreciprocal circuit device to form a filter attenuating unnecessary frequency components, the entire circuit structure can be made smaller than the structure including a discrete filter disposed outside of the device.

Recently, with an increasing need for further miniaturization of a mobile communication apparatus, there has been a demand for a smaller nonreciprocal circuit device incorporating an inductor for a filter. Thus, it is also necessary to reduce the size of the inductor for a filter. However, when an inductor formed by a solenoid is miniaturized, inductance of the inductor becomes smaller, thereby reducing attenuation in the second and third harmonics of the fundamental frequency. In addition, in order to miniaturize such a solenoid inductor without causing inductance reduction, it is considerable to form a solenoid inside a magnetic member. However, this arrangement requires a magnetic member and such a structure is difficult to manufacture, increasing cost.

SUMMARY OF THE INVENTION

Accordingly, it is an object of the present invention to provide a compact nonreciprocal circuit device in which a large amount of attenuation can be obtained in a predetermined frequency band without increasing cost. It is another object of the invention to provide a communication apparatus using the nonreciprocal circuit device.

According to a first aspect of the invention, there is provided a nonreciprocal circuit device including a magnetic member to which a DC magnetic field is applied, the magnetic member including a plurality of central conductors arranged to mutually intersect, one end of each of the central conductors being grounded, and a plurality of matching capacitors connected to a non-grounded end of each of the central conductors, in which at least one of the matching capacitors has a self-resonance frequency equal to or less than four times the central frequency of a pass band of the nonreciprocal circuit device.

In general, in a nonreciprocal circuit device, parallel resonance circuits are formed by central conductors having inductance components and matching capacitors to obtain matching with the central frequency of a pass band. With this arrangement, attenuation near the central frequency of the pass band can be almost removed. However, in this arrangement, it is impossible to obtain a filtering function for attenuating the spurious components of frequencies higher than the central frequency of the pass band. Thus, in the present invention, by appropriately designing the configurations of the matching capacitors, the self resonance frequency of the matching capacitor is set to be equal to or less than four times the central frequency of the pass band. Major spurious components are the second and third harmonics of a fundamental frequency (the central frequency of a pass band). The matching capacitor having a self-resonance frequency equal to or less than four times the central frequency acts as a trap filter for attenuating such spurious components. With this arrangement, the spurious components can be attenuated without increasing the number of components to be used.

Each of the capacitors used in the nonreciprocal circuit device may be a single-plate capacitor formed by disposing electrodes on both major surfaces of a dielectric substrate or a multi-layer capacitor formed by disposing electrodes on both major surfaces of a dielectric substrate and therein. In addition, each matching capacitor may be a chip capacitor formed by disposing a meandering-line electrode on a substrate. With such an arrangement, inductance components which the capacitor itself has can be increased and the capacitor can be made small having a low self-resonance frequency.

In addition, in the nonreciprocal circuit device, two or more matching capacitors may have self-resonance frequencies equal to or less than four times the central frequency of the pass band.

At least one of the matching capacitors may have a self-resonance frequency substantially two times the central frequency of the pass band.

At least one of the matching capacitors may have a self-resonance frequency substantially three times the central frequency of the pass band.

When the two or more matching capacitors have substantially the same self-resonance frequency equal to or less than four times the central frequency of the pass band, spurious components near the resonance frequency can be more significantly attenuated. Moreover, when the self-resonance frequencies of the two or more matching capacitors are different from each other, while both frequencies are equal to or less than four times the central frequency of the pass band, spurious components present over a wider frequency band can be attenuated. Major factors causing unnecessary radiation of a communication apparatus are spurious components such as the second and third harmonics of the fundamental frequency as mentioned above. Thus, by using the matching capacitor having the self-resonance frequency two times the fundamental frequency and the matching capacitor having the self-resonance frequency three times the fundamental frequency, the spurious components of the second and third harmonics of the fundamental frequency can be efficiently attenuated. In this case, the frequencies of "substantially two times" range from approximately 1.5 to 2.5 times the central frequency of the pass band. The frequencies of "substantially three times" range from approximately 2.5 to 3.5 times the central frequency of the pass band.

In the nonreciprocal circuit device according to the invention, the two or more matching capacitors may have self-resonance frequencies equal to or less than four times the central frequency of the pass band, and at least one of the matching capacitors may have a self-resonance frequency substantially twice the central frequency of the pass band.

Furthermore, at least one of the matching capacitors may have a self-resonance frequency substantially two times the central frequency of the pass band, and at least another matching capacitor may have a self-resonance frequency substantially three times the central frequency of the pass band.

In addition, the nonreciprocal circuit device may further include a series resonant circuit formed by connecting an inductor in series to the matching capacitor having the self-resonance frequency equal to or less than four times the central frequency of the pass band, the series resonant circuit having a resonance frequency over the central frequency of the pass band.

As shown here, when the inductor is connected in series to the matching capacitor, the resonance frequency of the series resonant circuit composed of the inductor and the matching capacitor becomes lower than the frequency four times the central frequency of the pass band as the self-resonance frequency of the matching capacitor. As a result, it is possible to form a trap filter by reducing the size of the matching capacitor. The self-resonance frequency of a matching capacitor to which no inductor is connected may be equal to or greater than four times the central frequency of the pass band or may be equal to or less than that.

Furthermore, the nonreciprocal circuit device may include series resonant circuits formed by connecting inductors to the two or more matching capacitors having the self-resonance frequencies equal to or less than four times the central frequency, the series resonant circuits having resonance frequencies over the central frequency of the pass band.

Furthermore, at least one of the series resonant circuits may have a resonance frequency substantially twice the central frequency of the pass band.

In addition, at least one of the series resonant circuits may have a resonance frequency substantially three times the central frequency of the pass band.

When the inductors are connected to the two or more matching capacitors to form the series resonant circuits, this arrangement can provide smaller trap filters capable of more greatly attenuating the spurious component of a specified frequency and attenuating spurious components existing over a wider frequency band. In this case, the frequencies of "substantially two times" range from approximately 1.5 to 2.5 times the central frequency of the pass band. The frequencies of "substantially three times" range from approximately 2.5 to 3.5 times the central frequency of the pass band.

The inductor described above is formed in various manners. For example, the inductor may be formed by extending one of the central conductors or may be formed by a chip to be disposed under a matching capacitor. In addition, the inductor may be formed either by integrating in the resin frame containing the matching capacitor or by cutting a part of a yoke forming a closed magnetic circuit. On upper and lower surfaces of chip inductors and chip capacitors, there can be disposed electrodes. Thus, by stacking these chip components, component space can be saved and connection between the components can be made easier. In addition, when forming the inductor by extending the central conductor, integrating the inductor in the resin frame, or by cutting a part of the yoke, the number of components to be used can be reduced. As a result, the manufacturing process can be simplified and cost can be reduced.

Furthermore, a series resonant circuit having substantially two times the central frequency of the pass band may be formed by connecting an inductor to at least one matching capacitor, and at least another matching capacitor may have a self-resonance frequency substantially three times the central frequency.

Furthermore, a series resonant circuit having substantially three times the central frequency of the pass band may be formed by connecting an inductor to at least one matching capacitor, and at least another one of the matching capacitors may have a self-resonance frequency substantially two times the central frequency.

Furthermore, a series resonant circuit having substantially two times the central frequency of the pass band may be formed by connecting an inductor to at least one matching capacitor, and another series resonant circuit may be formed by connecting an inductor to at least another matching capacitor having a self-resonance frequency substantially three times the central frequency.

Furthermore, an equivalent capacitance of each series resonant circuit at the central frequency of the pass band may be used as a matching capacitance with respect to the central frequency of the pass band. When the resonance frequency of the series resonant circuit is set to be higher than the central frequency of the pass band to remove the spurious components, the series resonant circuit exhibits a capacitive impedance with respect to the central frequency of the pass band. By appropriately setting the inductor and the capacitor of the series resonant circuit, there can be provided an equivalent matching capacitance with respect to the central frequency of the pass band. With this arrangement, when the series resonant circuit is disposed as a trap filter, it is unnecessary to dispose another matching capacitor. As a result, the number of components to be used can be reduced, thereby contributing to miniaturization of the device and cost reduction.

According to a second aspect of the present invention, there is provided a communication apparatus incorporating the nonreciprocal circuit device of the invention. In the communication apparatus, the nonreciprocal circuit device may be used as a circulator branching transmitted signals and received signals. With this arrangement, the communication apparatus can be miniaturized having good spurious characteristics.

BRIEF DESCRIPTION OF THE DRAWINGS

FIGS. 6A and 6B show the illustrations of another example of the matching capacitor used in the isolator of the second embodiment;

FIG. 7A shows a top view of an isolator according to a third embodiment of the invention, in which an upper yoke is removed, and FIG. 7B shows a side-sectional view thereof;

DESCRIPTION OF THE PREFERRED EMBODIMENTS

Figure 1:
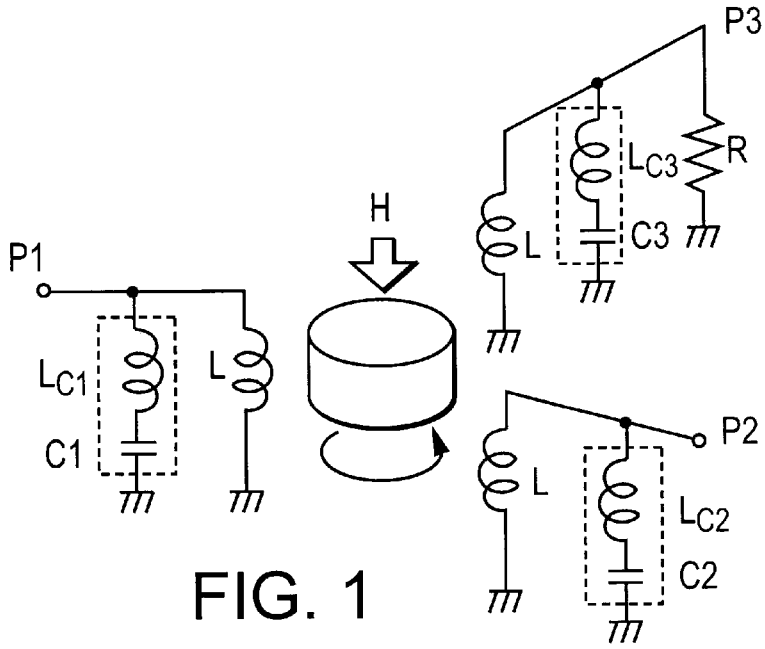
FIG. 1 shows an equivalent circuit diagram of an isolator according to a first embodiment of the present invention.

FIG. 1 shows an equivalent circuit diagram of an isolator according to a first embodiment of the invention. This isolator has the same component-arrangement as that shown in the conventional isolator shown in each of FIG. 19 and FIGS. 20A and 20B. Thus, the structure of the isolator according to the first embodiment will be illustrated with reference to these figures. In this isolator, a disk-shaped permanent magnet 3 is arranged on an inner surface of a box-shaped upper yoke 2 made of a magnetic metal. Then, the upper yoke 2 and a substantially U-shaped lower yoke 8 similarly made of the magnetic metal form a magnetic closed circuit. A resin frame 7 is arranged on a bottom surface 8*a* inside the lower yoke 8 as a case. Within the resin frame 7 are arranged a magnetic assembly 5, capacitors C1, C2, and C3, a termination resistor R, and an inductor L1.

The magnetic assembly 5 is formed as follows. Three central conductors 51, 52, and 53 have a common ground portion which has the same configuration as the bottom of a disk-shaped ferrite member 54. The common ground portion is abutted with a lower surface of the ferrite member 54. On a top surface of the ferrite member 54, the three central conductors 51, 52, and 53 extended from the ground portion are bent at an angle of 120 degrees from each other with an insulating sheet (not shown) interposed therebetween, and ports P1, P2, and P3 positioned at top ends of the central conductors 51, 52, and 53 are outwardly protruded. A DC magnetic field is applied to the magnetic assembly 5 by the permanent magnet 3 such that a magnetic flux passes through the ferrite member 54 in the thickness direction.

The resin frame 7 made of an electrically insulative material is formed by integrating a rectangular-frame-shaped side wall 7*a* with a bottom wall 7*b*. A round insertion through-hole 7*c* is formed in the center of the bottom wall 7*b*. Rectangular recesses 7*d*, 7*e*, and 7*f* are formed in a right-side portion, a left-side portion, and a front-side portion.

The magnetic assembly 5 is interposed in the round insertion through-hole 7*c*. The ground portions of the central conductors 51, 52, and 53 disposed on the lower surface of the magnetic assembly 5 are connected to the bottom surface 8*a* of the upper yoke 8*a* by soldering. Input/output terminals 71 and 72, and ground terminals 73 are insert-molded in the resin frame 7. The input/output terminals 71 and 72 are arranged at the rear of the right-and-left side surfaces of the resin frame 7, whereas the ground terminals 73 are arranged at the front thereof. One end of each of the ground terminals 73 is exposed inside the recesses 7*d*, 7*e*, and 7*f* of the bottom wall 7*b*, whereas the other ends of the terminals 73 are exposed on outer surfaces of the side wall 7*a* in right-and-left front positions. One end of the input/output terminal 71 is exposed on an upper surface of the bottom wall 7*b* in the rear of the right-side recess 7*d*, and the other end of the terminal 71 is exposed on an outer surface of the side wall 7*a* in a right-rear position thereof. One end of the input/output terminal 72 is exposed on the upper surface of the bottom wall 7*b* in the rear of the left-side recess 7*e*, and the other end of the terminal 72 is exposed on an outer surface of the side wall 7*a* in a left-rear position thereof.

In the recess 7*d* is arranged the matching chip capacitor C1, and in the recess 7*e* is arranged the matching chip capacitor C2. Lower-surface electrodes of the matching capacitors C1 and C2 are connected to the ground terminals 73 exposed in the recesses 7*d* and 7*e*. The matching chip capacitor C3 and the termination chip resistor R are aligned in the recess 7*f*. A lower-surface electrode of the matching capacitor C3 and a one-end-side electrode of the termination resistor R are connected to the ground terminals 73. The port P1 of the central conductor 51 is connected to an upper-surface electrode of the matching capacitor C1 and the input/output terminal 71. The port P2 of the central conductor 52 is connected to an upper-surface electrode of the matching capacitor C2 and the input/output terminal 72. The port P3 of the central conductor 53 is connected to an upper-surface electrode of the matching capacitor C3 and the remaining-end-side electrode of the termination resistor R. The ports P1, P2, and P3 are disposed in a stepped form so that the ports P1, P2, and P3 are flush with upper surfaces of the matching capacitors C1, C2, and C3.

In this situation, the matching capacitor C1 and an equivalent inductance L of the central conductor 51 form a parallel resonance circuit. The capacitance of the matching capacitor C1 is set in such a manner that a resonance frequency of the parallel resonance circuit is equal to the central frequency of a pass band of the isolator. In addition, the matching capacitor C1 is designed such that a self-resonance frequency of the matching capacitor C1 is approximately three times the central frequency of the pass band. For example, in the 1 GHz band, a matching capacitor of approximately 10 pF is used. When the capacitor having such a capacitance is formed by using a single-plate capacitor using rectangular electrodes, a self-resonance frequency of the capacitor is typically equal to 4 GHz or higher. Thus, in order to cause the self-resonance frequency of the capacitor to be lower, electrodes are made to be a strip shape or bent to increase an inductance component Lc.

In an equivalent circuit diagram shown in FIG. 1, as mentioned above, the matching capacitor C1 itself has a relatively large inductance component $L_{c1}$. With this arrangement, a series resonant circuit composed of the capacitance of the matching capacitor C1 and the inductance component $L_{c1}$ which the matching capacitor C1 has is formed between the input/output terminal 71 and the ground (the ground terminal 73). In this situation, the series resonant circuit acts as a trap filter. As mentioned above, the resonance frequency of the series resonant circuit, that is, the self-resonance frequency of the matching capacitor C1, is set to be approximately three times the central frequency of the pass band. As a result, of signals passing through the signal path, signals having frequency components approximately three times the central frequency of the pass band flow into the ground terminal via the series resonant circuit and are significantly attenuated. Inductances L shown in the figure are equivalent inductances formed by the ferrite member 54 and the central conductors 51, 52, and 53. In addition, the matching capacitor C1 acts as a capacitive impedance with respect to the central frequency of the pass band of the nonreciprocal circuit device and forms a matching circuit together with the inductance L.

When the isolator according to the first embodiment is applied in the 1-GHz band, the matching capacitor C1 is a single-plate capacitor having a relative permittivity of 100, a thickness of 0.2 mm, a width of 0.6 mm, a length of 3.0 mm, and a self-resonance frequency of 3.0 GHz. Each of the matching capacitors C2 and C3 are a single-plate capacitor having a relative permittivity of 100, a thickness of 0.2 mm, a width of 1.0 mm, a length of 1.9 mm, and a self-resonance frequency of 4.4 GHz. This single-plate capacitor has a capacitance of approximately 10 pF at 1 GHz and acts as a matching capacitance with respect to a signal of 1 GHz in the isolator.

Figure 2:
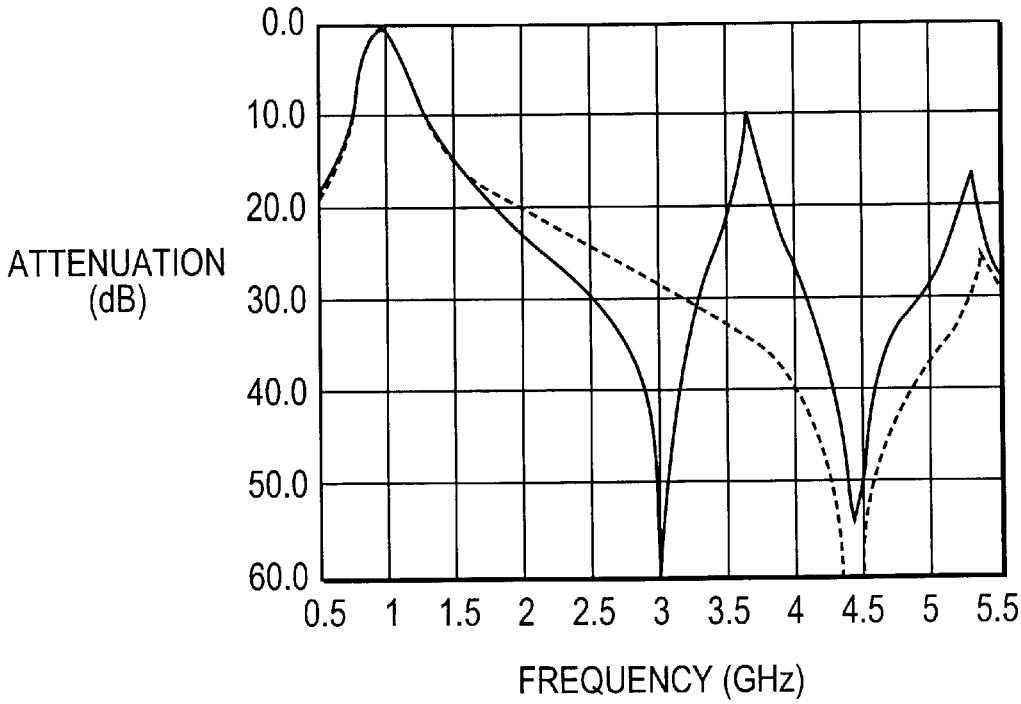
FIG. 2 shows a graph illustrating the frequency characteristics of attenuation obtained in each of the isolator and a conventional isolator applied in the 1 GHz band.

FIG. 2 shows a graph illustrating attenuation characteristics in a propagating direction obtained when the above isolator of the first embodiment is applied in the 1-GHz band. In this figure, a solid line indicates characteristics of the isolator of the first embodiment. A broken line indicates characteristics of the conventional isolator shown in each of FIGS. 19 to 21 applied in the 1-GHz band. In this case, all of the matching capacitors C1, C2, and C3 are single-plate capacitors having a relative permittivity of 100, a thickness of 0.2 mm, a width of 1.0 mm, a length of 1.9 mm, and a self-resonance frequency of 4.4 GHz. When the fundamental frequency is 1 GHz, in the conventional isolator, attenuation of the second harmonic is approximately 20.2 dB and attenuation of the third harmonic is approximately 28.2 dB. In contrast, in the isolator of the first embodiment, attenuation of the second harmonic is approximately 22.2 dB and attenuation of the third harmonic is approximately 57.5 dB. As a result, in the isolator of the first embodiment, attenuation is greater.

As mentioned above, by setting the self-resonance frequency of each matching capacitor to be approximately three times the central frequency of the pass band, the third harmonic of the central frequency can be significantly attenuated, and, in addition, the second harmonic can also be attenuated. Attenuation characteristics tend to be deteriorated in bands over the self-resonance frequency as compared with cases in bands below the self-resonance frequency. Therefore, when considering spurious distributions in signals, preferably, the self-resonance frequency is set to be substantially three times the central frequency of the pass band. That is, it is preferable that the self-resonance frequency is set to be in a range from 2.5 to 3.5 times the central frequency.

Figure 3:
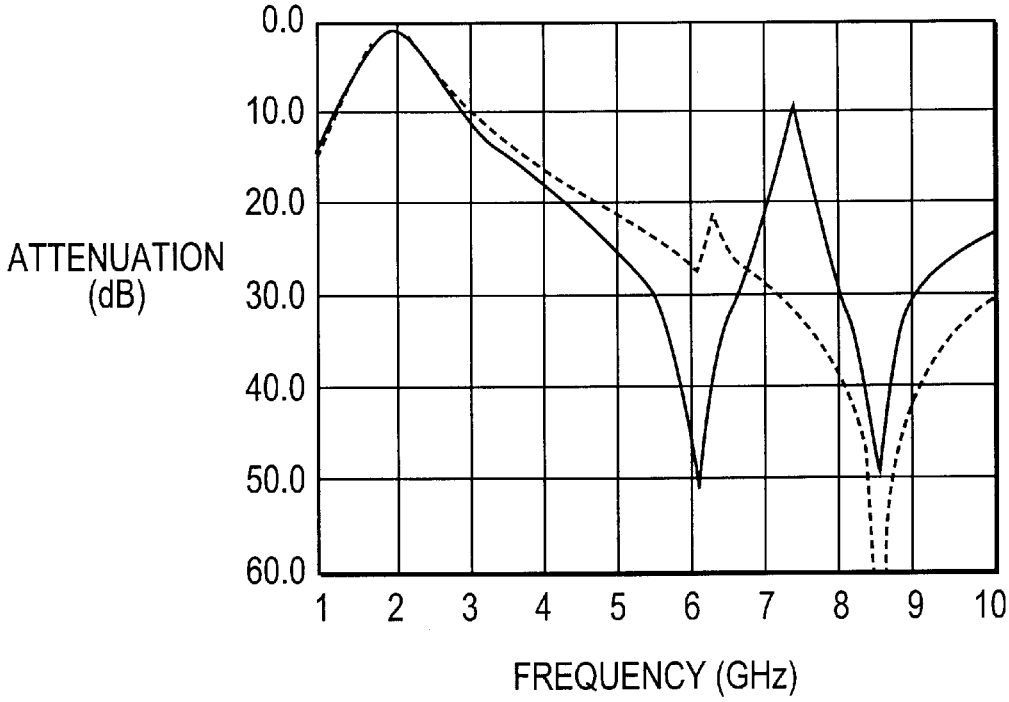
FIG. 3 shows a graph illustrating frequency characteristics of attenuation obtained in each of the isolator and the conventional isolator applied in the 2 GHz band.
Figure 19:
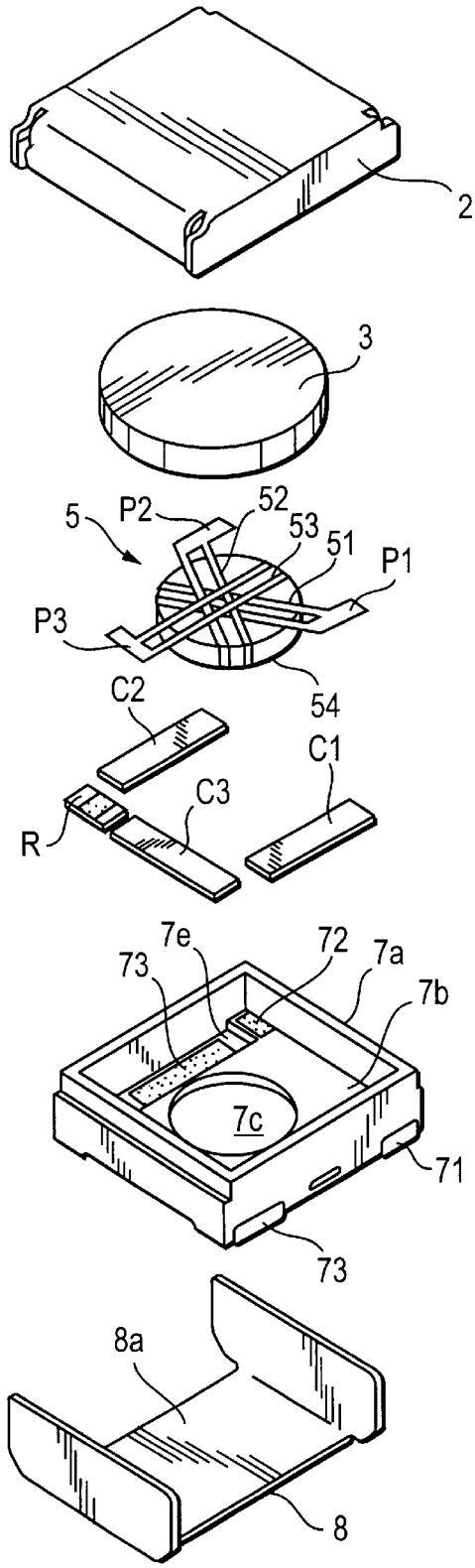
FIG. 19 PRIOR ART
FIG. 19 shows an exploded perspective view of the conventional isolator.
Figure 20A:
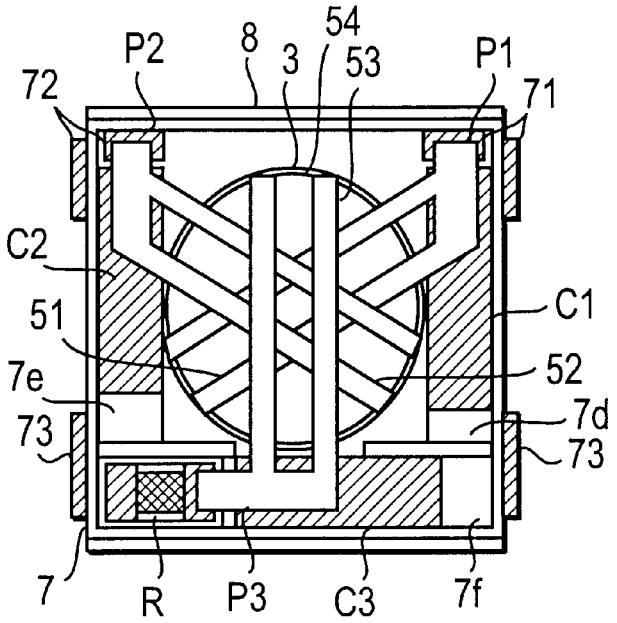
FIG. 20A PRIOR ART
FIG. 20A shows a top view of the conventional isolator and FIG. 20B shows a side-sectional view thereof, in which an upper yoke is removed.
Figure 20B:
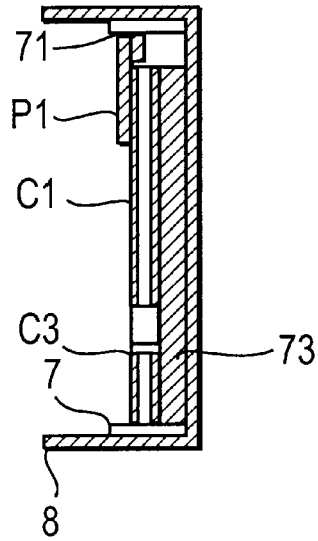
FIG. 20B PRIOR ART
Figure 21:
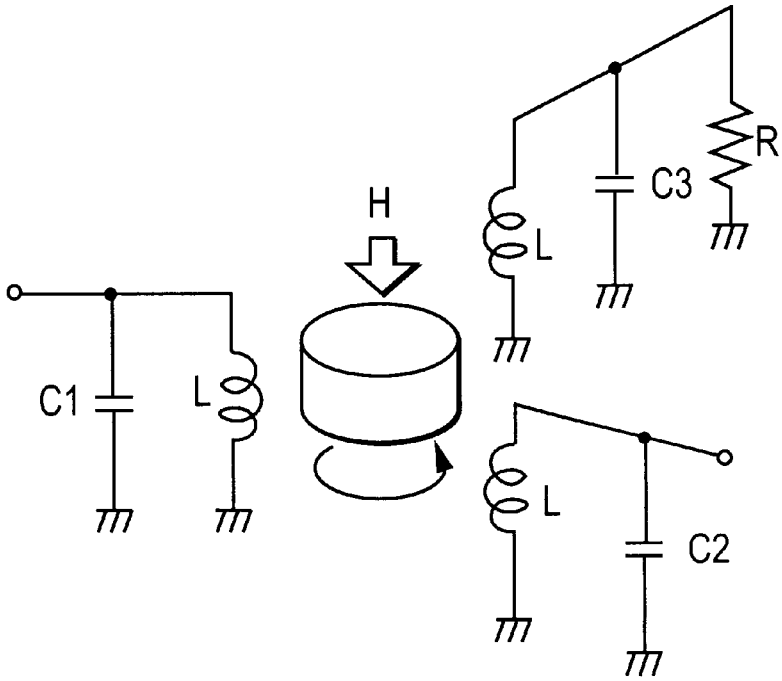
FIG. 21 PRIOR ART
FIG. 21 shows an equivalent circuit diagram of the conventional isolator.
Figure 22:
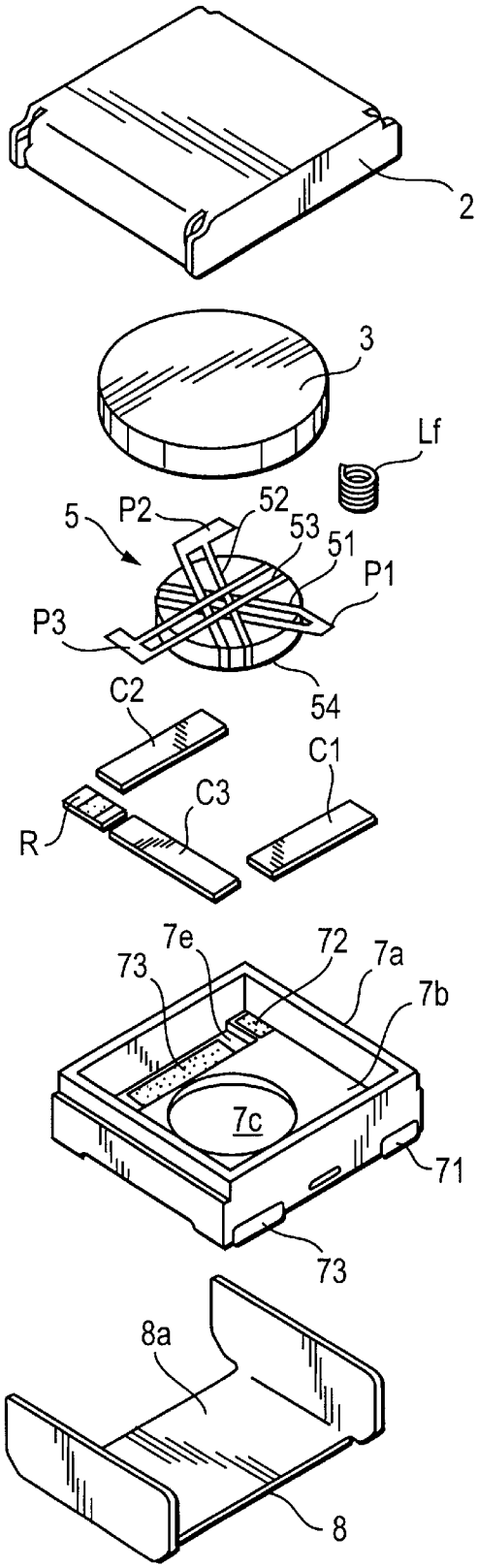
FIG. 22 PRIOR ART
FIG. 22 is an exploded perspective view of another conventional isolator.
Figure 23A:
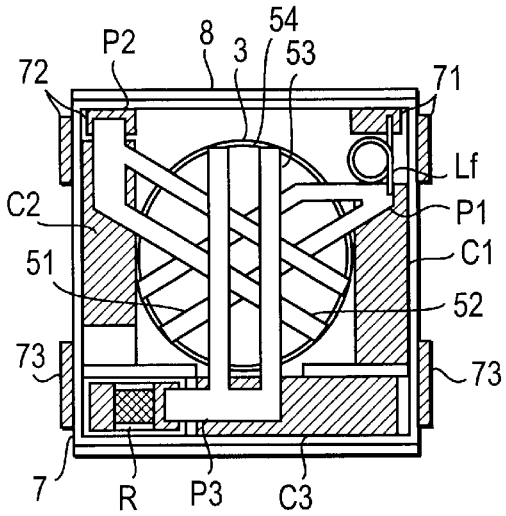
FIG. 23A PRIOR ART
FIG. 23A shows a top view of the other conventional isolator and FIG. 23B shows a side-sectional view thereof, in which an upper yoke is removed.
Figure 23B:
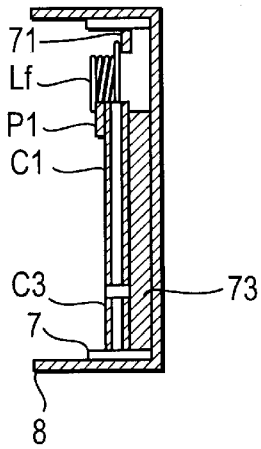
FIG. 23B PRIOR ART
Figure 24:
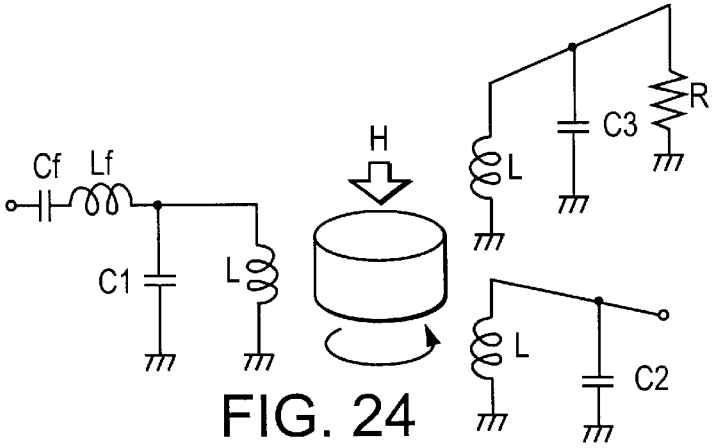
FIG. 24 PRIOR ART
FIG. 24 shows an equivalent circuit diagram of the other conventional isolator.
Figure 25:
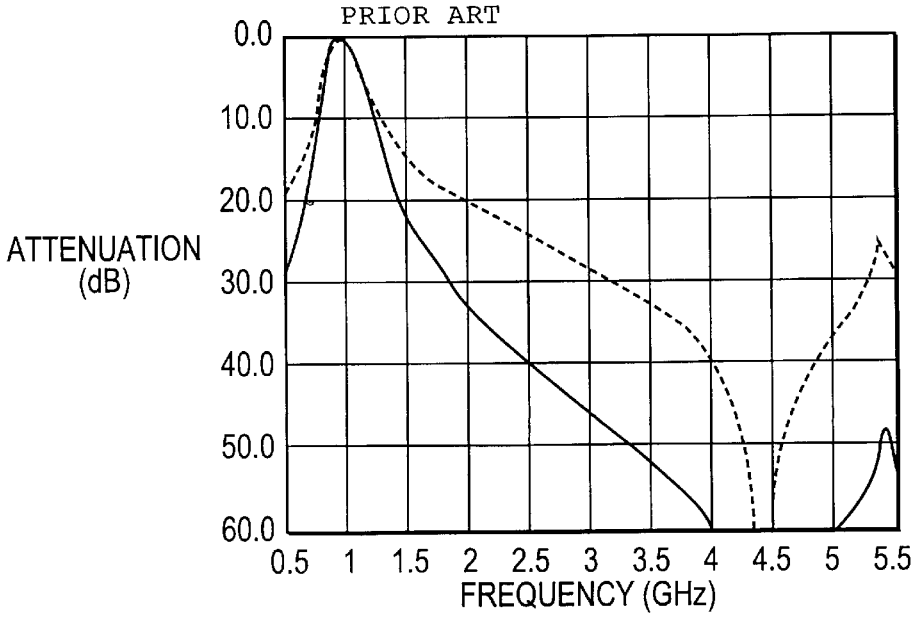
FIG. 25 PRIOR ART
FIG. 25 shows a graph illustrating the frequency characteristics of attenuation obtained in each of the two conventional isolators.

FIG. 3 shows attenuation characteristics in a propagating direction obtained when the isolator of the first embodiment is applied in the 2-GHz band. In the figure, a solid line indicates characteristics of the isolator of the first embodiment. A broken line indicates characteristics obtained when the conventional isolator shown in FIGS. 19 to 21 is applied in the 2-GHz band.

When the isolator of the first embodiment is applied in the 2-GHz band, the matching capacitor C1 is a single-plate capacitor having a relative permittivity of 30, a thickness of 0.2 mm, a width of 0.6 mm, a length of 2.6 mm, and a self-resonance frequency 6.1 GHz. As each of the matching capacitors C2 and C3, there is provided a single-plate capacitor having a relative permittivity of 30, a thickness of 0.2 mm, a width of 1.0 mm, a length of 1.8 mm, and a self-resonance frequency 8.4 GHz. Each capacitor has a capacitance of approximately 5 pF at 2 GHz and acts as a matching capacitance with respect to a signal of 2 GHz in the isolator. In addition, in the conventional isolator, all of the matching capacitors C1, C2, and C3 are single-plate capacitors having a relative permittivity of 30, a thickness of 0.2 mm, a width of 1.0 mm, a length of 1.8 mm, and a self-resonance frequency 8.4 GHz.

In FIG. 3, when the fundamental frequency is 2 GHz, in the conventional isolator having no trap filter composed of the series resonant circuit, attenuation of the second harmonic is approximately 15.6 dB and attenuation of the third harmonic is approximately 26.1 dB. In contrast, in the isolator of the first embodiment, attenuation of the second harmonic is approximately 17.4 dB and attenuation of the third harmonic is approximately 43.6 dB. As a result, in the isolator of the first embodiment, attenuation can be greater.

In the first embodiment described above, only the matching capacitor C1 has the self-resonance frequency approximately three times the central frequency of the pass band. However, it is also possible to set self-resonance frequencies of the plurality of matching capacitors to be approximately three times the central frequency of the pass band so that the attenuation of a specified spurious component can be increased and spurious components present over a wider frequency band can be attenuated.

Figure 4:
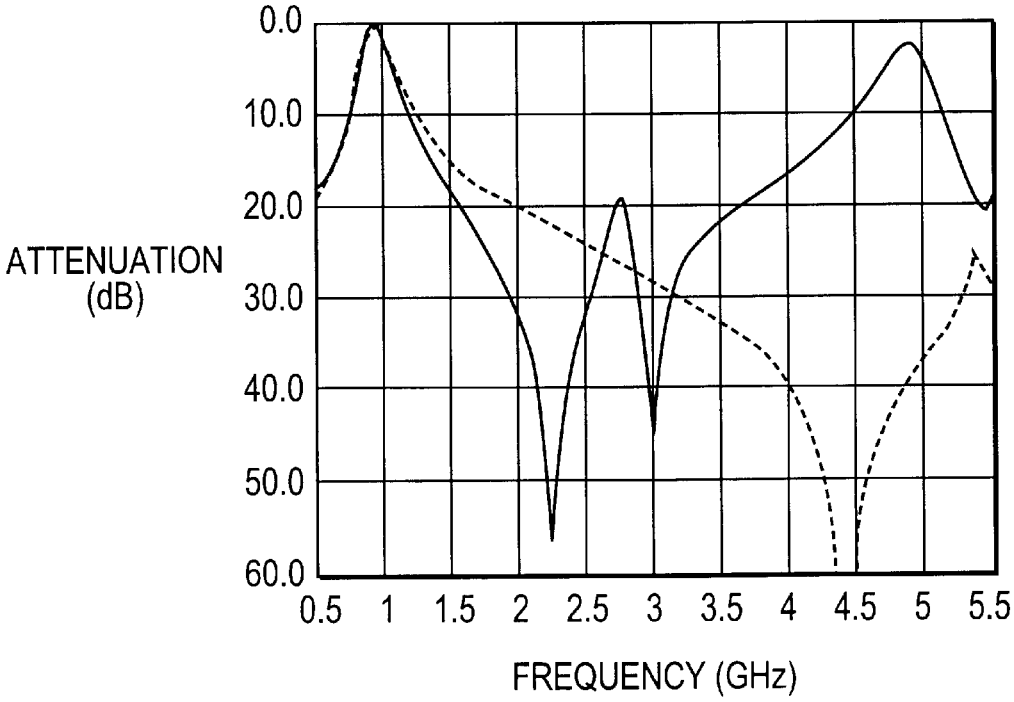
FIG. 4 shows a graph illustrating frequency characteristics of attenuation obtained in each of an isolator according to a second embodiment of the invention and the conventional isolator applied in the 1 GHz band.

FIG. 4 shows a-graph illustrating attenuation characteristics of an isolator according to a second embodiment of the invention. In this isolator, the resonance frequency of a matching capacitor C1 is set to be 2.3 times the central frequency of a pass band and the resonance frequency of a matching capacitor C2 is set to be three times the central frequency. The isolator of this embodiment is applied in the 1-GHz band. The matching capacitor C1 is a single-plate capacitor having a relative permittivity of 100, a thickness of 0.2 mm, a width of 0.3 mm, a length of 4.0 mm, and a self-resonance frequency 2.3 GHz. The matching capacitor C2 is a single-plate capacitor having a relative permittivity of 100, a thickness of 0.2 mm, a width of 0.6 mm, a length of 3.0 mm, and a self-resonance frequency 3.0 GHz. A matching capacitor C3 is a single-plate capacitor having a relative permittivity of 100, a thickness of 0.2 mm, a width of 1.0 mm, a length of 1.9 mm, and a self-resonance frequency 4.4 GHz. This single-plate capacitor has a capacitance of approximately 10 pF at 1 GHz and acts as a matching capacitance with respect to a signal of 1 GHz in this isolator.

In FIG. 4, a solid line indicates the characteristics of the isolator of the second embodiment. A broken line indicates the characteristics of the conventional isolator shown in each of FIGS. 19 to 21 applied in the 1 GHz band, and all of the matching capacitors C1, C2, and C3 are single-plate capacitors, each having a relative permittivity of 100, a thickness of 0.2 mm, a width of 1.0 mm, a length of 1.9 mm, and a self-resonance frequency of 4.4 GHz.

In this figure, when the fundamental frequency is 1 GHz, in the conventional isolator having no trap filter, attenuation of the second harmonic is approximately 20.2 dB and attenuation of the third harmonic is approximately 28.2 dB. In contrast, in the isolator of the second embodiment, attenuation of the second harmonic is approximately 29.3 dB and attenuation of the third harmonic is approximately 45.0 dB. As a result, attenuation can be greater in the isolator of the second embodiment.

As shown above, since the self-resonance frequency of one of the two matching capacitors is approximately two times the central frequency of the pass band and the self-resonance frequency of the remaining matching capacitor is approximately three times the central frequency, the second and third harmonics of the central frequency can be significantly attenuated. Since the second and third harmonics are major spurious components causing unnecessary radiation, it is preferable that the self-resonance frequency of one of the two matching capacitors is two times the central frequency and the self-resonance frequency of the remaining matching capacitor is three times the central frequency. In other words, preferably, the self-resonance frequency of one of the matching capacitors is set to be in a range from 1.5 to 2.5 times the central frequency of the pass band, and the self-resonance frequency of the remaining matching capacitor is set to be in a range from 2.5 to 3.5 times the central frequency.

In the above embodiments, the matching capacitors are single-plate capacitors in which rectangular electrodes are formed on the upper and lower surfaces of a single-plate dielectric member. Additionally, it is also possible to lower the self-resonance frequencies of the matching capacitor by designing the configurations of disposed electrodes in a such manner that areas of the capacitors can be reduced. FIGS. 5A and 5B and FIGS. 6A and 6B show the examples of such capacitors.

Figure 5A:
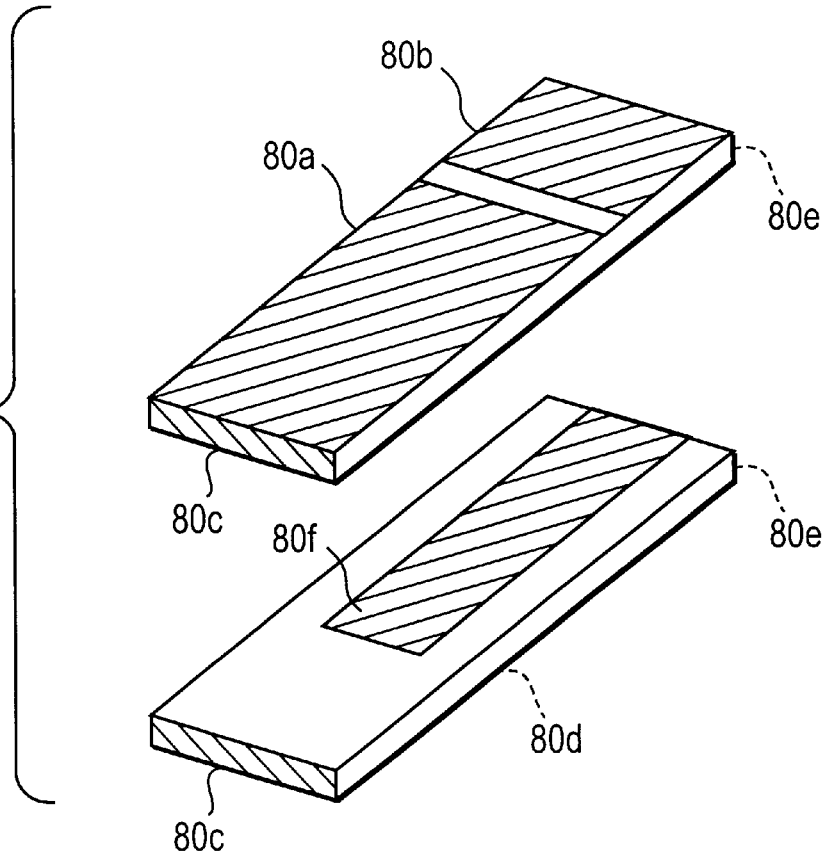
FIGS. 5A and 5B show the illustrations of an example of a matching capacitor used in the isolator of the second embodiment.
Figure 5B:
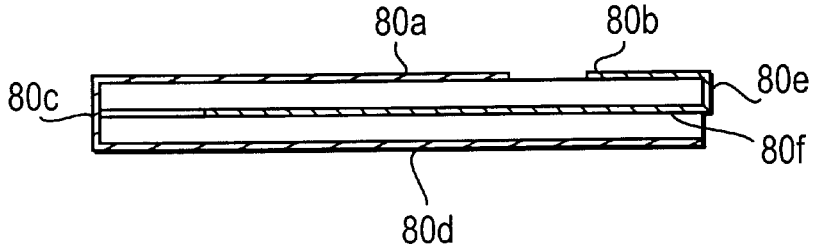

FIG. 5A shows an exploded structural view of the capacitor used in the above isolator and FIG. 5B shows a sectional view thereof. An upper-surface electrode of the capacitor is divided into two parts 80*a* and 80*b*. The electrode 80*a* is connected to a lower-surface electrode 80*d* via a side-surface electrode 80*c*. The upper-surface electrode 80*b* is connected to an inner electrode 80*f* via a side-surface electrode 80*e* opposing the side-surface electrode 80*c*. As shown here, by stacking the capacitors, the planar areas of the capacitor can be made smaller. As alternatives to the side-surface electrodes, through-holes may be used to connect the electrodes.

FIGS. 6A and 6B show the upper-surface electrodes of capacitors used in the above isolator. In the capacitor shown in FIG. 6A, the upper-surface electrode is formed by making one turn of a meandering line. In the capacitor shown in FIG. 6B, the upper electrode is formed by making four turns of a meandering line. On the entire lower surfaces of the capacitors, electrodes are disposed. By forming such meandering electrode lines, inductance components of the capacitors can be increased. Thus, the longitudinal lengths of the capacitors can be reduced, thereby leading to miniaturization of the nonreciprocal circuit device. However, instead of disposing the electrodes on the entire lower surfaces, electrodes may be partially disposed on the lower surfaces or may be formed like meandering lines.

Figure 8:
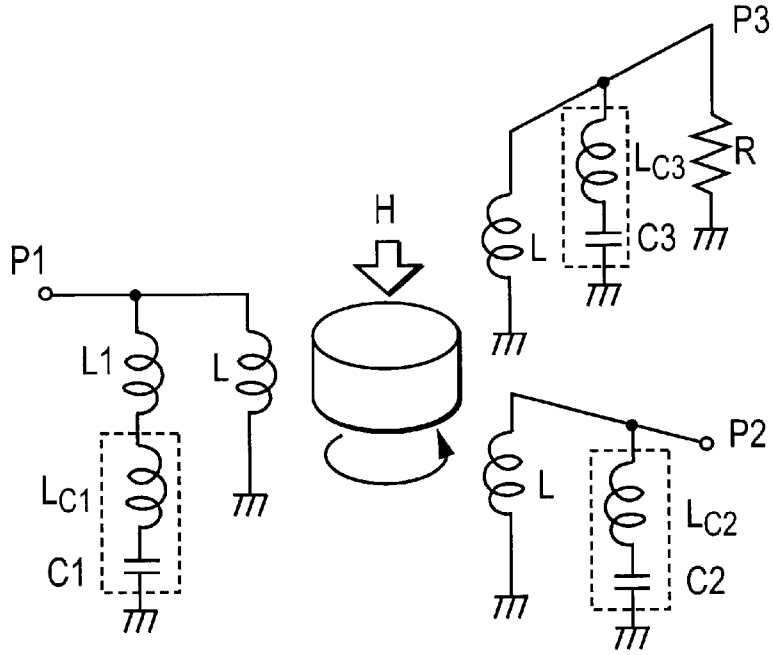
FIG. 8 shows an equivalent circuit diagram of the isolator of the third embodiment.

FIG. 7A shows a top view of an isolator according to a third embodiment, in which an upper yoke is removed. FIG. 7B shows a side-sectional view of the isolator. FIG. 8 shows an equivalent circuit diagram of the isolator. In this isolator, port P1 of a central electrode 51 is extended to form an inductor L1, via which an input/output terminal 71 is connected to a capacitor C1. With this arrangement, between the input/output terminal 71 and a ground is formed a series resonant circuit composed of the inductor L1, the capacitor C1, and the inductance component $L_{c1}$ of the capacitor.

When the above isolator is applied in the 1-GHz band, the matching capacitor C1 is a single-plate capacitor having a relative permittivity of 100, a thickness of 0.2 mm, a width of 0.7 mm, a length of 2.4 mm, and a self-resonance frequency of 3.6 GHz. The inductor L1 is 0.2 mm wide and 0.2 mm long, with an inductance of 0.1 nH. The resonance frequency of the series resonant circuit composed of the capacitor C1 including the inductance component $L_{c1}$ and the inductor L1 is 2.9 GHz. In addition, in the 1 GHz band, an equivalent capacitance of the series resonant circuit is approximately 10 pF. As a result, the series resonant circuit acts as a matching capacitance with respect to a signal of 1 GHz. As each of the matching capacitors C2 and C3, there is used a single-plate capacitor having a relative permittivity of 100, a thickness of 0.2 mm, a width of 1.0 mm, a length of 1.9 mm, and a self-resonance frequency 4.4 GHz. This single-plate capacitor has a capacitance of approximately 10 pF at 1 GHz and acts as a matching capacitance with respect to a signal of 1 GHz in this isolator.

Figure 9:
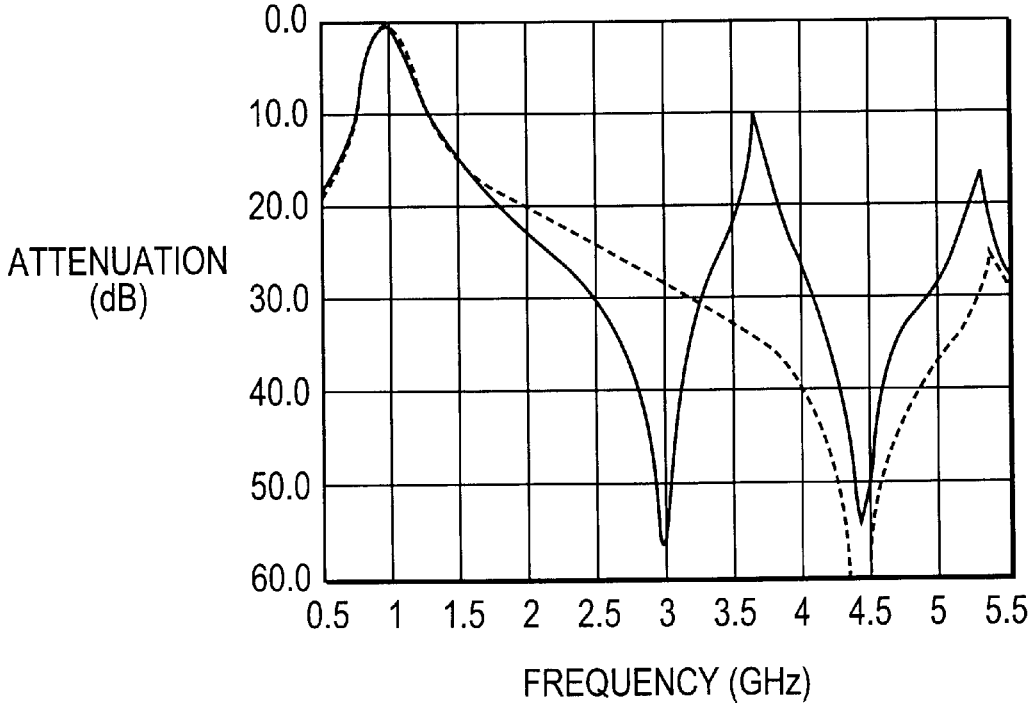
FIG. 9 shows a graph illustrating the frequency characteristics of attenuation obtained in each of the isolator of the third embodiment and the conventional isolator.

FIG. 9 shows a graph illustrating attenuation characteristics of the above isolator in a propagating direction obtained when the isolator is applied in the 1-GHz band. In this graph, a solid line indicates characteristics of the isolator according to the third embodiment. A broken line indicates characteristics of the conventional isolator shown in each of FIGS. 19 to 21 applied in the 1-GHz band. In this case, all of the capacitors C1, C2, and C3 are single-plate capacitors, each having a relative permittivity of 100, a thickness of 0.2 mm, a width of 1.0 mm, a length of 1.9 mm, and a self-resonance frequency of 4.4 GHz. When the fundamental frequency is 1 GHz, in the conventional isolator having no trap filter, attenuation of the second harmonic is approximately 20.2 dB and attenuation of the third harmonic is approximately 28.2 dB. In contrast, in the isolator of the third embodiment, attenuation of the second harmonic is approximately 22.5 dB and attenuation of the third harmonic is approximately 51.9 dB. As a result, in the isolator of the third embodiment, attenuation can be greater. As shown here, by connecting the inductor to the matching capacitors, the capacitors can be made compact, thereby contributing to miniaturization of the isolator.

In the isolator shown in each of FIGS. 7A and 7B to FIG. 9, the series resonant circuit acting as a trap filter is disposed between only the port P1 and the ground terminal. However, there may be disposed another trap filter between the port P2 and the ground terminal.

Figure 10:
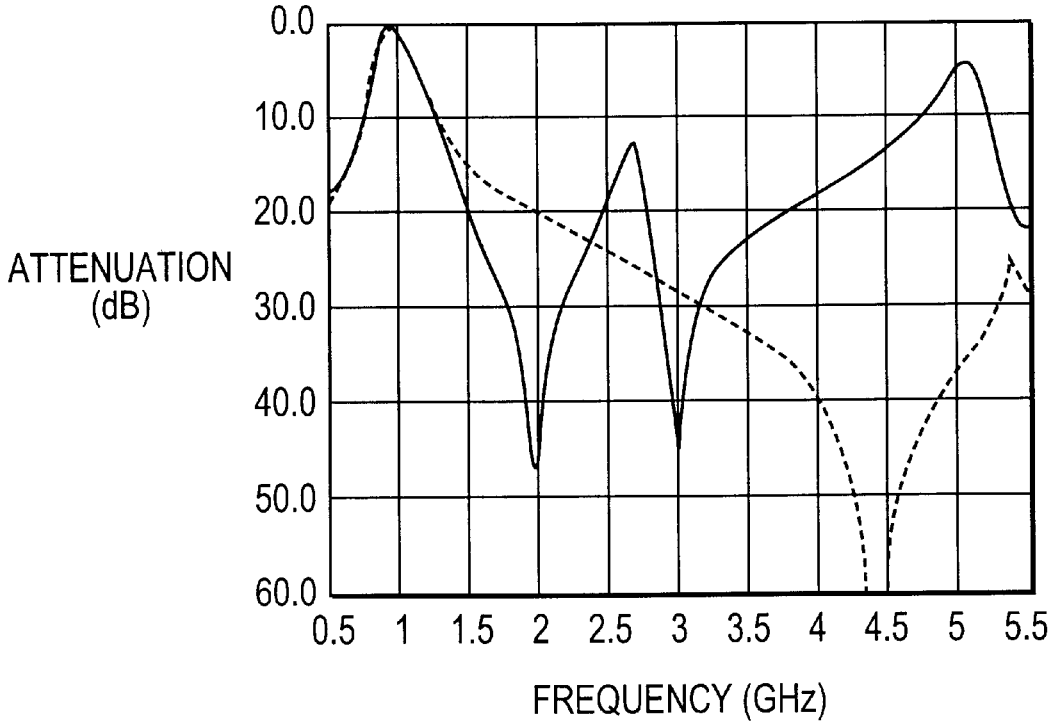
FIG. 10 shows a graph illustrating the frequency characteristics of attenuation obtained in each of an isolator according to a fourth embodiment-of the invention and the conventional isolator applied in the 1 GHz band.

FIG. 10 shows a graph illustrating the frequency characteristics of attenuation in an isolator according to a fourth embodiment of the invention. In this isolator, a series resonant circuit acting as a trap filter is disposed at port P1. Additionally, port 2 is connected to a matching capacitor acting as another trap filter and having a self-resonance frequency approximately three times the central frequency of a pass band. When the isolator of the fourth embodiment is applied in the 1-GHz band, as a matching capacitor C1, there is provided a single-plate capacitor having a relative permittivity of 100, a thickness of 0.2 mm, a width of 0.5 mm, a length of 2.7 mm, and a self-resonance frequency of 3.4 GHz. An inductor L1 is 0.2 mm wide and 0.9 mm long, with an inductance of 0.5 nH. A resonance frequency of the series resonant circuit composed of the capacitor C1 (including an inductance component) and the inductor L1 is 2.0 GHz. The series resonant circuit has an equivalent capacitance of approximately 10 pF at 1 GHz and acts as a matching capacitance with respect to a signal of 1 GHz in this isolator.

As a capacitor C2, there is provided a single-plate capacitor having a relative permittivity of 100, a thickness of 0.2 mm, a width of 0.6 mm, a length of 3.0 mm, and a self-resonance frequency of 3.0 GHz. In addition, as a capacitor C3, there is provided a single-plate capacitor having a relative permittivity of 100, a thickness of 0.2 mm, a width of 1.0 mm, a length of 1.9 mm, and a self-resonance frequency of 4.4 GHz. Each of these single-plate capacitors has a capacitance of approximately 10 pF at 1 GHz and acts as a matching capacitance with respect to a signal of 1 GHz in this isolator.

In this figure, a solid line indicates characteristics of the isolator according to the fourth embodiment. A broken line indicates characteristics of the conventional isolator shown in each of FIGS. 19 to 21 applied in the 1-GHz band. All of the capacitors C1, C2, and C3 are single-plate capacitors, each having a relative permittivity of 100, a thickness of 0.2 mm, a width of 1.0 mm, a length of 1.9 mm, and a self-resonance frequency of 4.4 GHz. When the fundamental frequency is 1 GHz, in the conventional isolator having no trap filter formed by the above resonance circuit, attenuation of the second harmonic is approximately 20.2 dB and attenuation of the third harmonic is approximately 28.2 dB. In contrast, in the isolator of the fourth embodiment, attenuation of the second harmonic is approximately 48.6 dB and attenuation of the third harmonic is approximately 47.2 dB. As a result, attenuation in the isolator of the fourth embodiment can be greater.

As shown above, when the series resonant circuit composed of the inductor and the matching capacitor is disposed between one port and a ground and the resonance frequency of the series resonant circuit is set to be approximately twice the central frequency of the pass band, whereas the self-resonance frequency of the matching capacitor at another port is set to be approximately three times the central frequency, the second and third harmonics of the central frequency can be significantly attenuated. The second and third harmonics are major spurious components causing unnecessary radiation. Thus, it is preferable that the self-resonance frequency of the series resonant circuit is two times the central frequency and the self-resonance frequency of the matching capacitor is three times the central frequency, as described above. In other words, preferably, the resonance frequency of the series resonant circuit is set to be in a range from 1.5 to 2.5 times the central frequency, and the self-resonance frequency of the matching capacitor is set to be in a range from 2.5 to 3.5 times the central frequency.

Next, with reference to FIGS. 11 and 12, a description will be given of an isolator according to a fifth embodiment. In this isolator, a series resonant circuit composed of an inductor and a capacitor is formed at each of ports P1 and P2.

Figure 11:
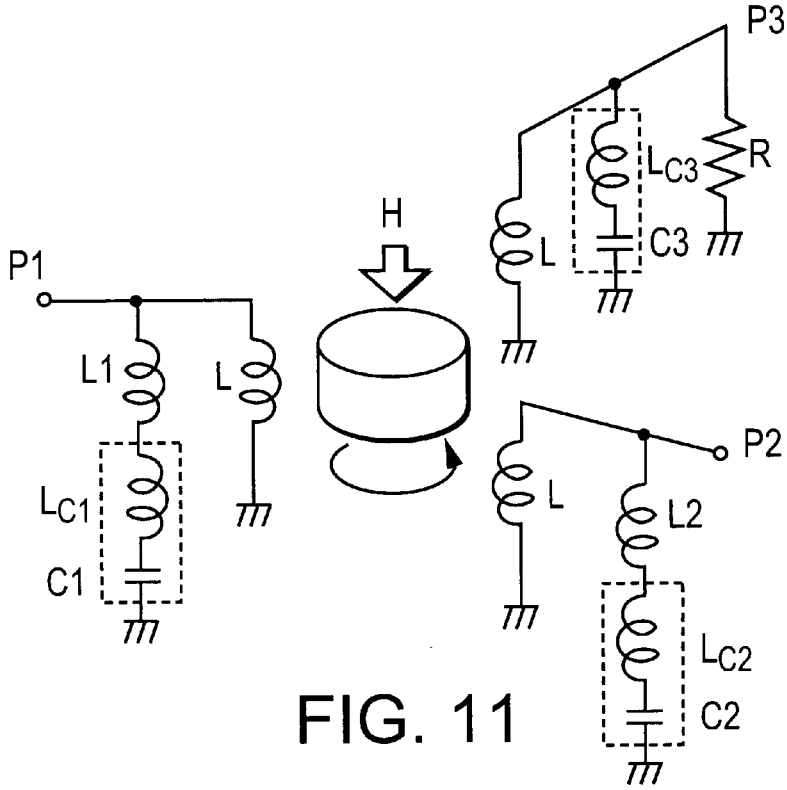
FIG. 11 shows an equivalent circuit diagram of an isolator according to a fifth embodiment of the invention.

FIG. 11 shows an equivalent circuit diagram of the isolator of the fifth embodiment. Between the port P1 (an input/output terminal 71) and a ground, there is formed a series resonant circuit composed of an inductor L1 and a capacitor C1 (including an inductance component $L_{c1}$). Similarly, between the port P2 (an input/output terminal 72) and a ground, there is formed a series resonant circuit composed of an inductor L2 and a capacitor C2 (including an inductance component $L_{c2}$).

The capacitor C1 is a single-plate capacitor having a relative permittivity of 100, a thickness of 0.2 mm, a width of 0.5 mm, a length of 2.7 mm, and a self-resonance frequency 3.4 GHz. The inductor L1 is 0.2 mm wide and 0.9 mm long, with an inductance of 0.5 nH. A resonance frequency of the series resonant circuit composed of the inductor L1 and the capacitor C1 is 2.0 GHz. The series resonant circuit has an equivalent capacitance of approximately 10 pF at 1 GHz, and acts as a matching capacitance with respect to a signal of 1 GHz in this isolator. The capacitor C2 is a single-plate capacitor having a relative permittivity of 100, a thickness of 0.2 mm, a width of 0.7 mm, a length of 2.4 mm, and a self-resonance frequency 3.6 GHz. The inductor L2 is 0.2 mm wide and 0.2 mm long, with an inductance of 0.1 nH. A resonance frequency of the series resonant circuit composed of the inductor L2 and the capacitor C2 is 3.0 GHz. The series resonant circuit has an equivalent capacitance of approximately 10 pF at 1 GHz and acts as a matching capacitance with respect to a signal of 1 GHz in this isolator. In addition, the capacitor C3 is a single-plate capacitor having a relative permittivity of 100, a thickness of 0.2 mm, a width of 1.0 mm, a length of 1.9 mm, and a self-resonance frequency 4.4 GHz. The matching capacitor has a capacitance of approximately 10 pF at 1 GHz and acts as a matching capacitance with respect to a signal of 1 GHz in this isolator.

Figure 12:
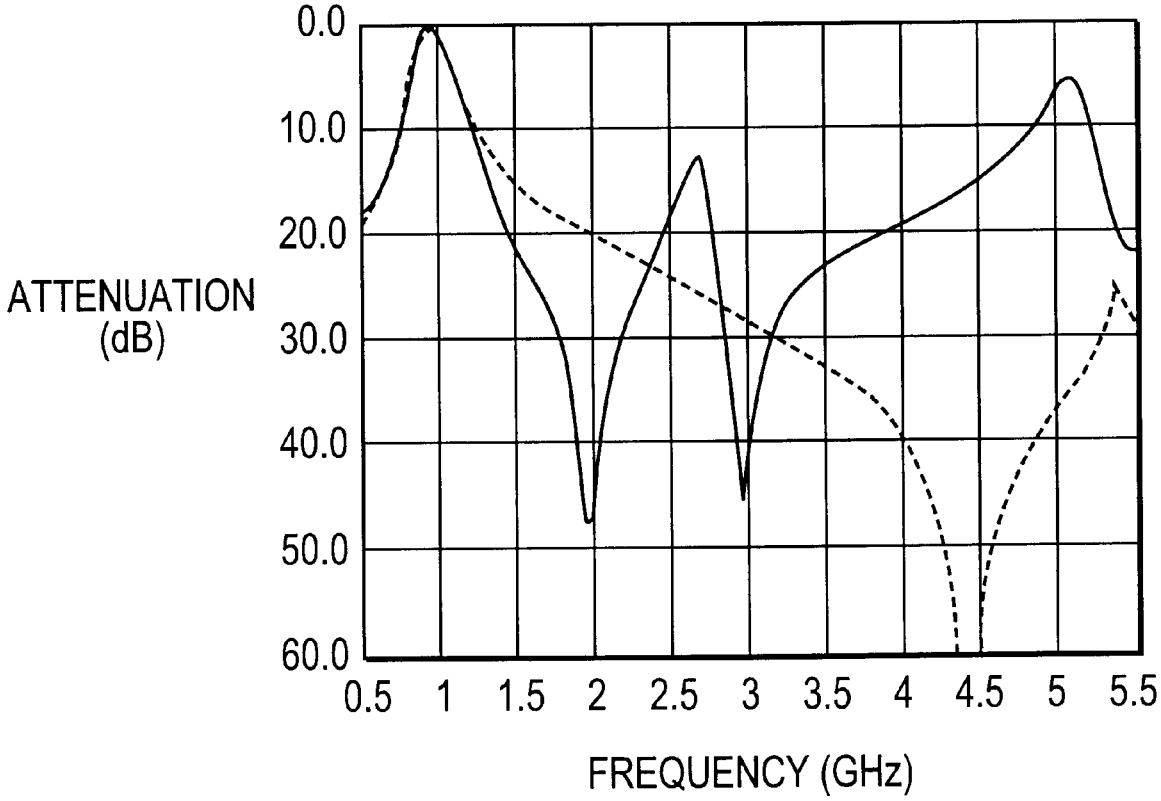
FIG. 12 shows a graph illustrating the frequency characteristics of attenuation obtained in each of a modified example of the isolator according to the fifth embodiment and the conventional isolator applied in the 1 GHz band.

FIG. 12 shows frequency characteristics of attenuation in the isolator of the fifth embodiment. In this graph, a solid line indicates characteristics of the isolator of the fifth embodiment. A broken line indicates characteristics of the conventional isolator shown in each of FIGS. 19 to 21 applied in the 1-GHz band. In this case, all the matching capacitors C1, C2, and C3 are single-plate capacitors having a relative permittivity of 100, a thickness of 0.2 mm, a width of 1.0 mm, a length of 1.9 mm, and a self-resonance frequency of 4.4 GHz. When the fundamental frequency is 1 GHz, in the conventional isolator having no trap filter formed by the series resonant circuit, attenuation of the second harmonic is approximately 20.2 dB and attenuation of the third harmonic is approximately 28.2 dB. In contrast, in the isolator of the fifth embodiment, attenuation of the second harmonic is approximately 48.8 dB and attenuation of the third harmonic is approximately 47.2 dB. As a result, attenuation in the isolator of the fifth embodiment can be greater.

As mentioned above, when the series resonant circuits composed of the inductors and the matching capacitors are disposed in parallel between the two ports (input/output terminals) and the grounds, and the resonance frequency of one of the resonance circuits is set to be approximately twice the central frequency of the pass band and the resonance frequency of the other series resonant circuit is set to be approximately three times the central frequency, the second and third harmonics of the central frequency can be significantly attenuated. The second and third harmonics are major spurious components causing unnecessary radiation. Thus, preferably, one of the self-resonance frequencies of the series resonant circuit is set to be two times the central frequency and the self-resonance frequency of the remaining series resonant circuit is set to be three times the central frequency as described above. In other words, it is preferable that the resonance frequencies of the series resonant circuits are within a range from 1.5 to 2.5 times the central frequency, and the self-resonance frequencies of the matching capacitors are within a range from 2.5 to 3.5 times the central frequency.

In the above embodiment, although the inductor L1 is formed by extending the port of the central conductor, the inductor L1 may be contained or formed under the matching capacitor. An isolator having such a structure will be shown in FIG. 13 to FIGS. 17A to 17C.

Figure 13:
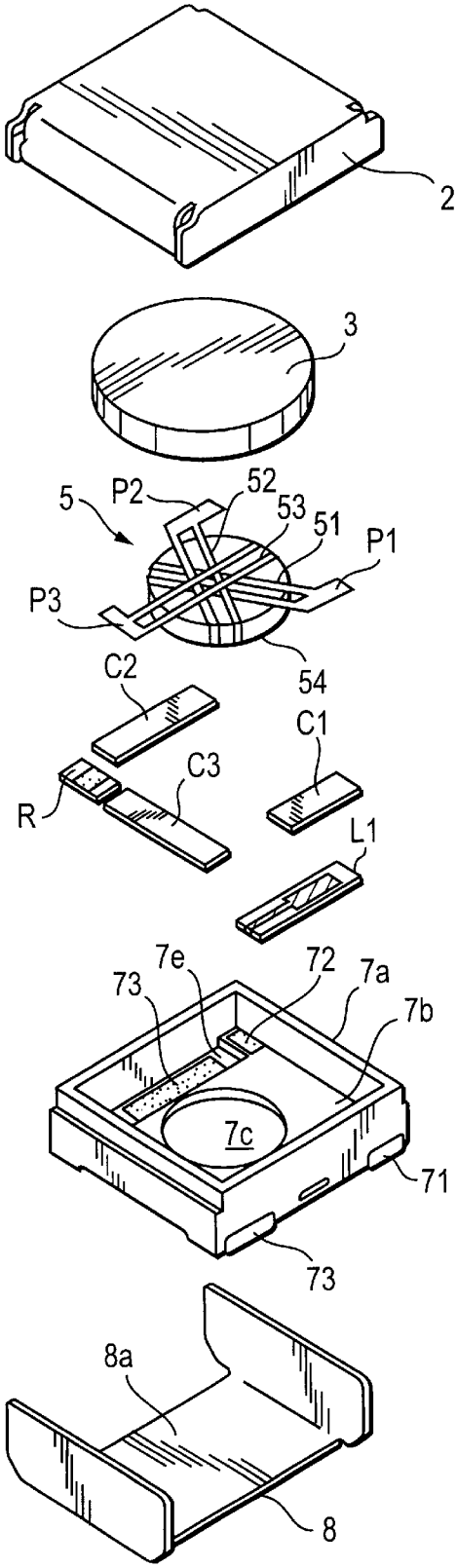
FIG. 13 shows an exploded perspective view of an isolator according to a sixth embodiment of the invention.
Figure 14A:
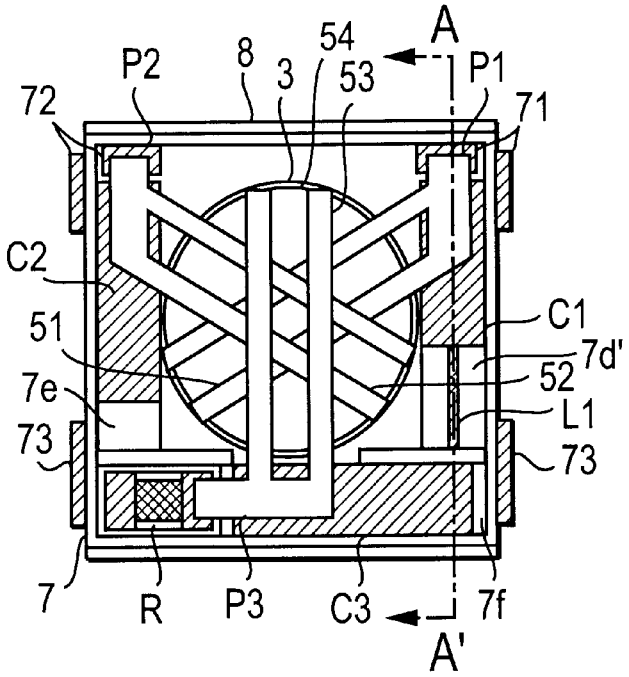
FIG. 14A shows a top view of the isolator of the sixth embodiment and FIG. 14B shows a side-sectional view thereof in which an upper yoke is removed.
Figure 14B:
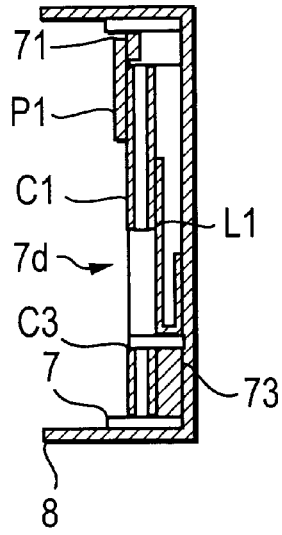
Figure 15:
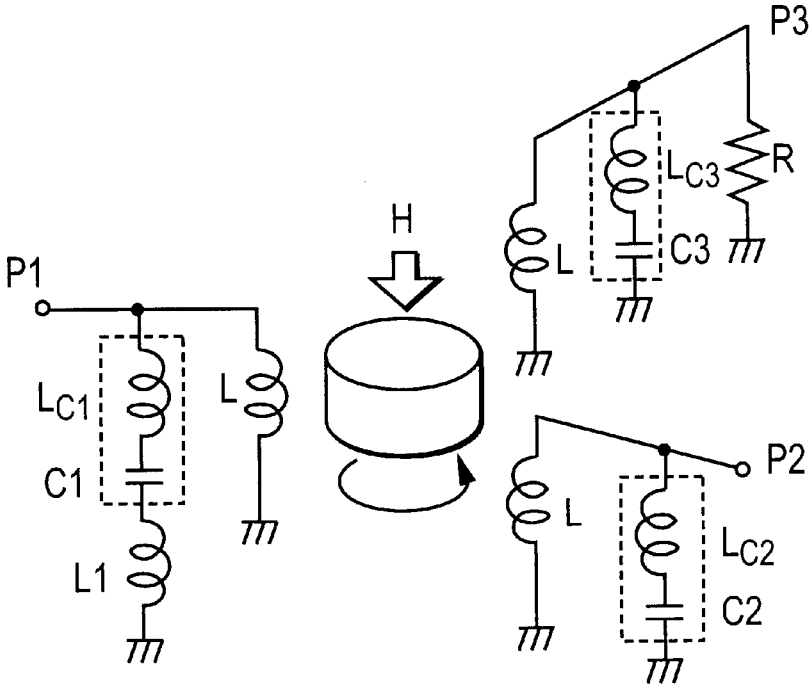
FIG. 15 shows an equivalent circuit diagram of the isolator of the sixth embodiment.

Each of FIGS. 13 to 15 shows an isolator according to a sixth embodiment of the invention, in which a chip inductor is disposed under a capacitor C1. FIG. 13 shows an exploded perspective view of the isolator. FIG. 14A shows a top view of the isolator, in which an upper yoke 2 is removed and FIG. 14B shows a side-sectional view of the isolator. FIG. 15 shows an equivalent circuit diagram of the isolator. Unlike the isolator of the first embodiment (see FIGS. 19 and 20), in a resin frame 7 used in the isolator of the sixth embodiment, the recess 7*d* for containing the capacitor C1 is formed as a through-hole 7*d*' and a chip inductor L1 is disposed under the capacitor C1. The chip inductor L1 is formed by disposing electrodes on a dielectric substrate. An upper-surface electrode of the inductor L1 is connected to a lower-surface electrode of the capacitor C1 and a lower-surface electrode of the inductor L1 is connected to a lower yoke 8.

With the above structure, as seen in the equivalent circuit diagram shown in FIG. 15, at an input/output terminal 71, there is formed a series resonant circuit composed of the inductor L1 and the capacitor C1 (including an inductance component $L_{c1}$) As in the embodiment above, the capacitor used in this embodiment has a self-resonance frequency lower than usual. For example, the capacitor has a self-resonance frequency approximately three times the central frequency of a pass band. In this manner, a compact isolator can be obtained by using such a capacitor having a lower self-resonance frequency and a small inductor.

The series resonant circuit composed of the inductor L1 and the capacitor C1 (including the inductance component $L_{c1}$) has a high resonance frequency two or three times the central frequency of the pass band. Thus, the series resonant circuit is an equivalent capacitance appropriate to the central frequency of the pass band and acts as a matching capacitance with respect to signals of the central frequency of the pass band in this isolator.

In this embodiment, the chip inductor L1 is formed by disposing electrodes on both main surfaces of a dielectric substrate. However, as an alternative to the dielectric substrate, a magnetic substrate may be used. Electrodes may be disposed not only on both main surfaces of the substrate but thereinside. In addition, instead of directly connecting a lower-surface electrode of the inductor L1 to a lower yoke 8, the lower-surface electrode thereof may be connected to a ground terminal 73. Furthermore, the lower yoke 8 as a case may be integrally formed in the resin frame 7 by insert-molding the lower yoke 8 in the resin frame 7. Additionally, a ground terminal may be formed on the lower yoke 8.

Figure 16A:
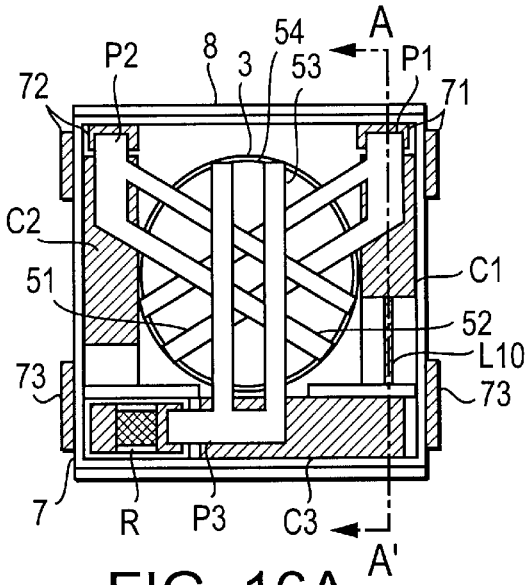
FIG. 16A shows a top view of an isolator according to a seventh embodiment and FIG. 16B shows a side-sectional view thereof, in which an upper yoke is removed.
Figure 16B:
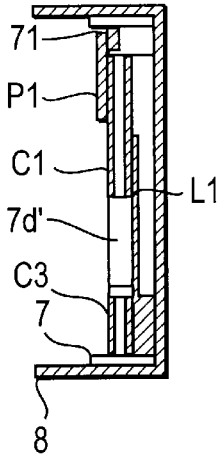

FIG. 16 shows an isolator according to a seventh embodiment of the invention. In this isolator, an inductor Li is integrally formed in a resin frame 7 by insert-molding the inductor L1 in a bottom wall 7*b* of the resin frame 7. In this embodiment, unlike the sixth embodiment shown in FIGS. 13 to 15, instead of forming a through-hole 7*d*' in the right-side portion of the bottom wall 7*b* of the resin frame 7, like the first embodiment, there is formed a recess 7*d* in the right-side portion. That is, the right-side portion of the bottom wall 7*b* is not allowed to penetrate through to a lower yoke 8, and the resin bottom wall is thereby left. In addition, the inductor L1 is insert-molded in the bottom wall of the recess. A capacitor C1 is arranged in the recess 7*d,* and a lower-surface electrode of the capacitor C1 is connected to an upper-surface electrode (hot end) of the inductor L1. A lower-surface electrode (cold end) of the inductor L1 is connected to a ground terminal 73. As shown here, when the inductor L1 is integrally formed in the resin frame 7 to form a series resonant circuit composed of the capacitor C1 and the inductor L1, the number of components to be used can be reduced as compared with a case in which a chip inductor is used.

The cold end of the inductor L1 may be connected to the lower yoke 8. In this case, a ground terminal may be disposed on the lower yoke 8. Additionally, the lower yoke 8 may be integrally formed by insert-molding the lower yoke 8 in the resin frame 7.

Figure 17A:
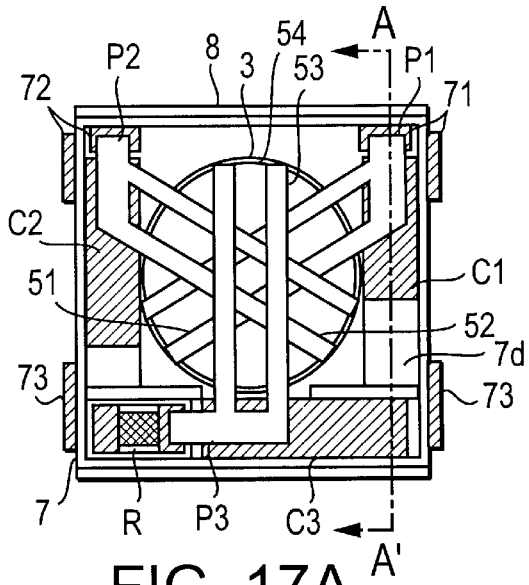
FIG. 17A shows a top view of an isolator according to an eighth embodiment.
Figure 17B:
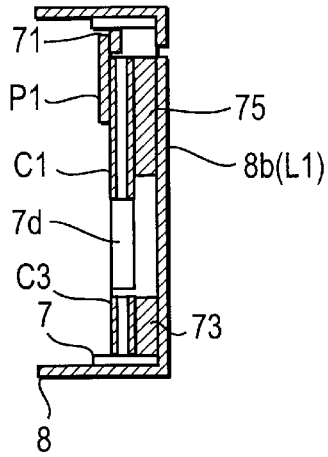
FIG. 17B shows a side-sectional view thereof, in which an upper yoke is removed.
Figure 17C:
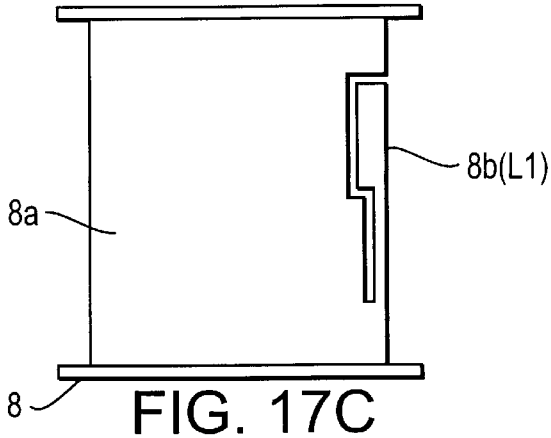
FIG. 17C shows a top view of a lower yoke.

FIGS. 17A to 17C show the illustrations of an isolator according to an eighth embodiment of the invention. In this isolator, a part of a lower yoke 8 as a case is cut out to form a tongue-like portion as an inductor L1 (8*b*). In this embodiment, unlike the embodiment shown in FIGS. 13 to 15, as mentioned above, the inductor L1 is formed by cutting out a part of the lower yoke 8. Additionally, at the right-side portion of the bottom wall 7*b,* there is formed a recess 7*d.* In a bottom wall of the recess 7*d,* there is insert-molded an electrode 75 connecting a capacitor C1 and the hot end of the inductor L1.

Since the lower yoke 8 is connected to a ground terminal 73, the cold end of the inductor L1 is accordingly connected to the ground. In this manner, by forming the inductor L1 as a part of the lower yoke 8, when a series resonant circuit composed of the capacitor C1 and the inductor L1 is formed, the number of components can be reduced as compared with the case in which the inductor is a chip component.

In this embodiment, although the resin frame 7 and the lower yoke 8 are independently formed, the lower yoke 8 may be inert-molded in the resin frame 7 to be integrally formed in the resin frame 7. In addition, in this embodiment, although a lower-surface electrode of the capacitor C1 is connected to the hot end of the inductor L1 via the electrode 75 insert-molded in the bottom wall of the resin frame 7, the lower-surface electrode of the capacitor C1 and the hot end of the inductor L1 may be directly connected to each other by disposing a through-hole in the resin frame 7. Furthermore, a ground terminal may be formed on the lower yoke 8.

In each of the embodiments shown in FIG. 13 to FIGS. 17A to 17C, the trap filter formed by a series resonant circuit is arranged only at the input/output terminal 71 (port P1). However, another trap filter formed by a series resonant circuit may be formed at the input/output terminal 72 (port P2). In this case, when one of the series resonant circuits has a resonance frequency twice the central frequency of a pass band of the isolator and the remaining series resonant circuit has a resonance frequency three times the central frequency, the second and third harmonics of the fundamental frequency can be efficiently attenuated. However, this is not only the case applicable to the present invention as long as the resonance frequency of each series resonant circuit is higher than the central frequency. Additionally, all of the series resonant circuits may have the same resonance frequency.

Similarly, the self-resonance frequencies of the two matching capacitors C1 and C2 used in the embodiment shown in FIG. 4 may be the same. Also, in the embodiment shown in FIG. 10, the resonance frequency of the series resonant circuit composed of the capacitor C1 and the inductor L1 may be the same as the self-resonance frequency of the matching capacitor C2. Furthermore, the two series resonant circuits in the embodiment shown in FIG. 12, which include the series resonant circuit composed of the capacitor C1 and the inductor L1 and the series resonant circuit composed of the capacitor C2 and the inductor L2, may have the same resonance frequency.

In addition, in each of the embodiments shown in FIG. 1 to FIGS. 17A to 17C, the two series resonant circuits may have the same resonance frequency. In this case, signal components near the resonance frequency can be more significantly attenuated.

Each of the above embodiments has illustrated the isolator by way of example. However, the present invention can also be applied to a circulator, in which port P3 of a third central conductor is formed as a third input/output terminal instead of connecting a termination resistor R to the port P3. In this case, as in the case of port P1 or P2, the port P3 may be connected to a matching capacitor having a self-resonance frequency equal to or less than four times the central frequency of a pass band or may be connected to a trap filter formed by a series resonant circuit. Also, the port P3 may be connected to a matching capacitor C3 and an input/output terminal as usual.

When a trap filter is formed at the port P3, the trap filter may have the same resonance frequency as that of a trap filter formed at one of the ports P1 and P2, or the trap filter may have a third resonance frequency different from those of the trap filters at the ports P1 and P2. In addition, all of the three series resonant circuits may have the same resonance frequency.

Of the three ports, a signal sent from each input/output terminal in the circulator passes through both the port of a terminal to which the signal is input and the port of a terminal from which the signal is output. In this situation, the trap filter disposed at each of the two ports through which the signal passes attenuates a spurious component of the signal. Thus, when different signals pass through each signal path in the circulator, spurious components of the different signals can be efficiently removed by appropriately setting the resonance frequencies of the three trap filters according to fundamental frequencies and spurious components of the signals passing through the paths.

Furthermore, the entire structure of the nonreciprocal circuit device of this invention is not restricted to those shown in FIG. 1 to FIGS. 17A to 17C. For example, the nonreciprocal circuit device of the invention may have a structure in which central conductors are formed inside a multi-layer substrate.

Figure 18:
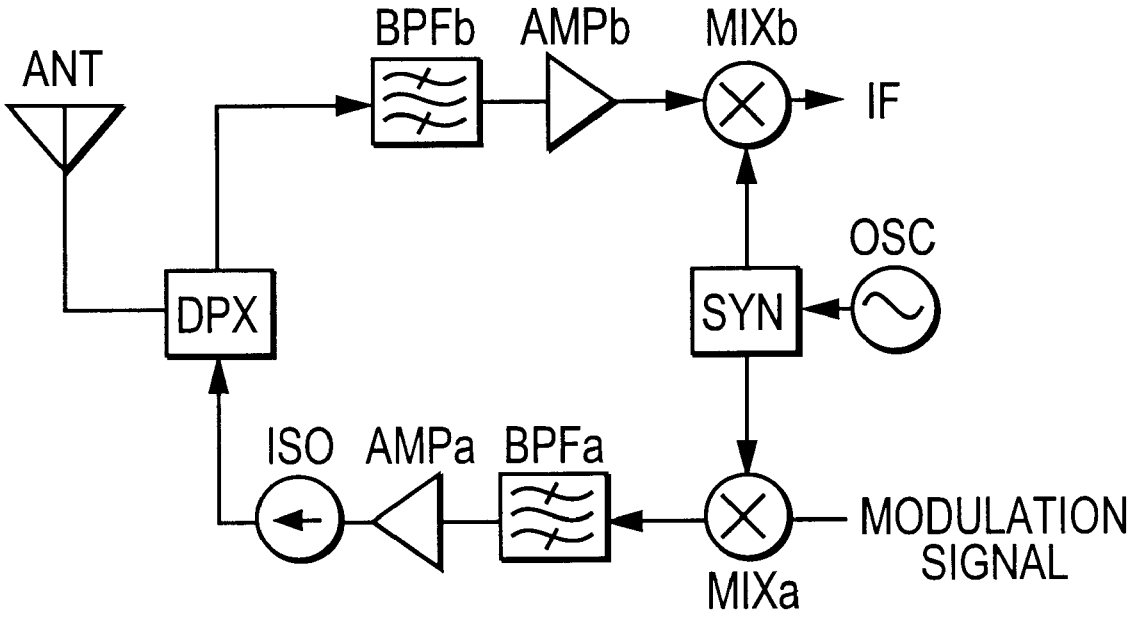
FIG. 18 shows a block diagram illustrating the structure of a communication apparatus according to a ninth embodiment of the invention.

Next, a communication apparatus incorporating the isolator according to a ninth embodiment of the invention will be illustrated with reference to FIG. 18. In this figure, the reference character ANT denotes a transmission/reception antenna, the reference character DPX denotes a duplexer, the reference characters BPFa, BPFb, and BPFc denote band pass filters, the reference characters AMPa and AMPb denote amplifying circuits, the reference characters MIXa and MIXb denote mixers, the reference character OSC denotes an oscillator, and the reference character SYN denotes a frequency synthesizer. The MIXa modulates a frequency signal output from the SYN by using a modulation signal. The BPFa passes only a transmission-frequency signal and the AMPa amplifies the signal, which are transmitted from the ANT via the ISO and the DPX. Of the signals output from the DPX, the BPFb passes only a reception-frequency signal and the AMPb amplifies the signal. The MIXb mixes the frequency signal output from the SYN and the received signal to output an intermediate frequency signal IF.

As the isolator ISO, the nonreciprocal circuit device shown in each of FIG. 1 to FIGS. 17A to 17C and the like is used. The isolator has band elimination characteristics and low pass characteristics. Thus, the band pass filter BPFa passing only the transmission-frequency signal may be omitted. In this manner, an overall compact communication apparatus can be formed.

As described above, when the self-resonance frequency of the matching capacitor is set to be equal to or less than four times the central frequency of the pass band, the so-called trap filter can be formed by the arrangement. As a result, without increasing the number of components, spurious components such as the second and third harmonics can be attenuated.

In addition, when the self-resonance frequencies of two or more matching capacitors are set to be equal to or less than four times the central frequency of the pass band, the attenuation ratio of spurious components can be greater. Also, spurious components present over a wider frequency band can be attenuated. Furthermore, when at least one of the two or more matching capacitors has the self-resonance frequency substantially two times the central frequency of the pass band and at least another matching capacitor has the self-resonance frequency substantially three times the central frequency, the second harmonic and the third harmonic as spurious components at higher signal levels can be more significantly attenuated.

Moreover, in this invention, without increasing the size of the matching capacitor, the inductance component can be increased. Thus, the trap filter using the self-resonance frequency of the matching capacitor can be miniaturized.

Furthermore, when the inductor is connected in series to the matching capacitor, the resonance frequency of a series resonant circuit composed of the inductor and the matching capacitor is lower than the self-resonance frequency of the matching capacitor. As a result, both the matching capacitor and the nonreciprocal circuit device can be made compact. In addition, when the two or more matching capacitors are connected to the inductors to form the series resonant circuits, the attenuation ratio of spurious components can be increased and spurious components over a wider frequency band can be attenuated. Moreover, when at least one of the above series resonant circuits has a self-resonance frequency substantially two times the central frequency of the pass band and at least another series resonant circuit has a self-resonance frequency substantially three times the central frequency, the second and third harmonics as spurious components at higher signal levels can be more significantly attenuated.

In addition, according to an aspect of this invention, since the series resonant circuit can be used as a matching capacitance of a matching circuit, it is unnecessary to dispose another matching capacitance. Thus, this arrangement can contribute to simplification of the manufacturing process, miniaturization of the device, and cost reduction.

Furthermore, according to another aspect of the invention, since spurious characteristics can be improved, the communication apparatus of the invention can be made compact while suppressing unnecessary radiation from the apparatus.

While preferred embodiments have been described, it is to be understood that variations thereto will occur within the scope of the present inventive concepts delineated by the following claims.

What is claimed is:

1. A nonreciprocal circuit device comprising:

a magnetic member to which a DC magnetic field is applied, said magnetic member including a plurality of central conductors arranged to mutually intersect, one end of each of the central conductors being grounded; and a plurality of matching capacitors connected to a non-grounded end of each of the central conductors;

wherein at least one of the matching capacitors includes an inductance component and a capacitance, said at least one of the matching capacitors has a self-resonance frequency equal to or less than four times the central frequency of a pass band of the nonreciprocal circuit device which is obtained by adjusting the inductance component and the capacitance of said at least one of the matching capacitors.

2. A nonreciprocal circuit device according to claim 1, wherein two or more of the matching capacitors have self-resonance frequencies equal to or less than four times the central frequency of the pass band.

3. A nonreciprocal circuit device according to one of claims 1 and 2, wherein at least one of the matching capacitors has a self-resonance frequency substantially two times the central frequency of the pass band.

4. A nonreciprocal circuit device according to one of claims 1 and 2, wherein at least one of the matching capacitors has a self-resonance frequency substantially three times the central frequency of the pass band.

5. A nonreciprocal circuit device according to one of claims 1 and 2, wherein each of the matching capacitors is a chip capacitor formed by disposing a meandering-line electrode on a substrate.

6. A nonreciprocal circuit device according to claim 1, further comprising a series resonant circuit formed by connecting an inductor in series to said matching capacitor having a self-resonance frequency equal to or less than four times the central frequency of the pass band, the series resonant circuit having a resonance frequency greater than the central frequency of the pass band.

7. A nonreciprocal circuit device according to claim 6, comprising series resonant circuits formed by connecting inductors to the two or more matching capacitors having the self-resonance frequencies equal to or less than four times the central frequency of the pass band, the series resonant circuits having resonance frequencies greater than the central frequency of the pass band.

8. A nonreciprocal circuit device according to one of claims 6 and 7, wherein at least one of the series resonant circuits has a resonance frequency substantially two times the central frequency of the pass band.

9. A nonreciprocal circuit device according to one of claims 6 and 7, wherein at least one of the series resonant circuits has a resonance frequency substantially three times the central frequency of the pass band.

10. A nonreciprocal circuit device according to one of claims 6 and 7, wherein an equivalent capacitance of the series resonant circuit at the central frequency of the pass band is set to be a matching capacitance with respect to the central frequency of the pass band.

11. A communication apparatus incorporating the nonreciprocal circuit device according to claim 1.

* * * * *